US008011039B2

(12) United States Patent
Stryker et al.

(10) Patent No.: US 8,011,039 B2
(45) Date of Patent: Sep. 6, 2011

(54) PATIENT SUPPORT WITH UNIVERSAL ENERGY SUPPLY SYSTEM

(75) Inventors: Martin Stryker, Kalamazoo, MI (US); Kevin Conway, Kalamazoo, MI (US); Scott Davis, Oshtemo, MI (US)

(73) Assignee: Stryker Corporation, Kalamazoo, MI (US)

( * ) Notice: Subject to any disclaimer, the term of this patent is extended or adjusted under 35 U.S.C. 154(b) by 605 days.

(21) Appl. No.: 12/057,941

(22) Filed: Mar. 28, 2008

(65) Prior Publication Data

US 2008/0250564 A1 Oct. 16, 2008

Related U.S. Application Data

(60) Provisional application No. 60/923,501, filed on Apr. 13, 2007, provisional application No. 60/968,780, filed on Aug. 29, 2007.

(51) Int. Cl.
*A61G 7/00* (2006.01)

(52) U.S. Cl. ..... 5/600; 5/86.1; 5/614

(58) Field of Classification Search ..... 5/600, 611, 5/614, 86.1

See application file for complete search history.

(56) References Cited

U.S. PATENT DOCUMENTS

| | | | | |
|---|---|---|---|---|
| 4,584,989 | A * | 4/1986 | Stith | 600/18 |
| 4,768,241 | A * | 9/1988 | Beney | 5/600 |
| 5,236,004 | A | 8/1993 | Sunderland et al. | |
| 5,251,347 | A | 10/1993 | Hopper et al. | |
| 5,749,374 | A * | 5/1998 | Schneider, Sr. | 128/870 |
| 5,991,947 | A * | 11/1999 | Lavin et al. | 5/600 |
| 6,155,260 | A * | 12/2000 | Lavin et al. | 128/845 |
| 6,546,577 | B1 * | 4/2003 | Chinn | 5/600 |
| 6,553,588 | B2 * | 4/2003 | Hensley et al. | 5/600 |
| 6,829,796 | B2 | 12/2004 | Salvatini et al. | |
| 6,895,715 | B2 | 5/2005 | Gallant et al. | |
| 7,644,458 | B2 | 1/2010 | Foster et al. | |
| 2006/0168731 | A1 | 8/2006 | Menkedick et al. | |

OTHER PUBLICATIONS

PCT Search Report dated Aug. 7, 2008 for corresponding PCT International Application No. PCT/US08/59006.

* cited by examiner

*Primary Examiner* — Michael Trettel
(74) *Attorney, Agent, or Firm* — Warner Norcross & Judd LLP

(57) ABSTRACT

A patient support including a patient support surface, a fluid movement system provided at the patient support, and a plurality of ports mounted at the patient support, which are in selective fluid communication with the fluid movement system. At least one of the ports is adapted for coupling to a device for delivering fluid to the device from the fluid movement system or delivering a vacuum pressure to the device from the fluid movement system for suctioning fluid through the device when the device is coupled to the port.

33 Claims, 21 Drawing Sheets

PATIENT SUPPORT WITH UNIVERSAL ENERGY SUPPLY SYSTEM

CROSS-REFERENCE TO RELATED APPLICATIONS

This application claims benefit of U.S. provisional application Ser. No. 60/923,501, filed Apr. 13, 2007, entitled UNIVERSAL ENERGY SUPPLY, by Applicants Martin Stryker, Kevin Conway, and Scott Davis and claims benefit of U.S. provisional application Ser. No. 60/968,780, filed Aug. 29, 2007, entitled UNIVERSAL ENERGY SUPPLY, by Applicants Martin Stryker, Kevin Conway, and Scott Davis, both of which are incorporated herein by reference in their entireties.

TECHNICAL FIELD AND BACKGROUND OF THE INVENTION

The present invention relates a patient support and, more specifically, to a patient support that incorporates a universal energy supply system for delivering energy or healing fluids to one or more devices at the patient support for treating or caring for a patient.

SUMMARY OF THE INVENTION

According to the present invention, a patient support includes a patient support surface, a fluid movement system provided at the patient support, and a plurality of ports, which are also provided at the patient support and in selective fluid communication with the fluid movement system. At least one of the ports is adapted for coupling to a device for delivering fluid to or suctioning fluid from the device when the device is coupled to the at least one port.

In another form of the invention, a patient support includes a patient support surface and an energy supply system provided at the patient support. The energy supply system includes a control system and a fluid movement system and, further, a plurality of ports in selective fluid communication with the fluid movement system. The control system controls the flow of fluid to or from the ports through the fluid movement system. At least one of the ports is adapted for coupling to a device for moving fluid to or from the device when the device is coupled to the at least one port.

In either of these patient supports, the patient support is configured to detect the device when the device is in close proximity to or coupled to one of the ports. For example, the patient support may be configured to detect the type of the device or information about the device. Suitable fluids include air or other gases or liquids, for example water or treatment liquids, including healing fluids. In some applications, the fluid may include a drug.

In another aspect of either of the patient supports, the port is coupled to a device, such as an inflatable device, a conduit, an air operated device, an actuator, a ventilator, and a chamber. For example, the inflatable device may include an inflatable chamber, an inflatable siderail, an inflatable cuff, an inflatable bag, or an inflatable mattress or pad, including an inflatable mattress or pad that is configured for turning a patient, for applying vibration or percussion treatment to a patient to prevent bed sores, to provide respiratory treatment, to retard the development of decubitus ulcers, or the like.

In a further aspect, the patient support surfaces may each comprise a frame and a mattress, with the ports provided at the frame. Further, the ports are provided at spaced locations around the patient support so that a care giver can access the fluid movement system from either side or end of the bed.

According to yet a further aspect, the patient supports optionally include a heating or cooling device for heating or cooling the fluid in the fluid movement system.

In other aspects, the patient supports may include a compressor for pressurizing the fluid in the fluid movement system so that the fluid movement system may deliver pressurized fluid. Optionally, the fluid movement system may provide high pressure/low volume fluid at one or more ports and high volume/low pressure fluid at one or more other ports.

Additionally, the fluid movement system may include a vacuum line in selective fluid communication with the ports wherein the vacuum line provides suction at a respective port when the vacuum line is in fluid communication with the respective port.

In yet another form of the invention, a patient support includes a patient surface and a fluid movement system provided at the support, with the fluid movement system including a fluid delivery system, a vacuum system, and a plurality of ports in selective fluid communication with the fluid delivery system and the vacuum system. At least one of the ports is adapted for coupling to a device for delivering fluid or a vacuum pressure to the device when the device is coupled to the at least one port.

In one aspect, the fluid movement system is configured to couple to an external fluid supply. Optionally, an onboard fluid supply is provided at the patient support so that the control system can deliver fluid from either the external fluid supply or the onboard fluid supply. Further, the fluid movement system may be configured to couple to an external vacuum supply. Again, the patient support may optionally include an onboard vacuum supply. In this manner, the patient support can provide continuous care of a patient whether or not the patient support is coupled to an external vacuum or fluid supply.

In one aspect, the support includes a control system that is configured to detect the type of the device. For example, the ports may be provided with a sensor, such as an RFID reader that detects an RFID tag associated with a device that is to be coupled to the energy supply system, with the RFID tag identifying the device and/or providing information about the device. Further, the control system is configured to control the pressure of the fluid in the fluid movement system to suit the device based on the information received by the RFID reader. In this manner, the patient support can adapt its energy supply system to suit the device that is coupled to the patient support.

In other aspects, the at least one port is coupled to a device, such as an inflatable device, a conduit, an air operated device, such as an actuator or tool, a ventilator, or a chamber.

In another aspect, the patient support surface comprises a frame and a mattress, with the ports provided at the frame.

According to yet another embodiment, a patient support includes an inflatable device, which may be selectively inflated by the patient support. For example, the inflatable device may comprise a chamber, a cuff, a wound cover, a patient lift transfer device, a mattress or pillow, or the like.

In one aspect, the patient support may incorporate a compartment or housing to store a supply of the inflatable devices. For example, the compartment or housing may be mounted beneath the patient support surface of the patient support, for example beneath the frame that supports the patient support surface, or in or at the footboard board, headboard, or one of the side rails.

In another form of the invention, a patient support is coupled to treatment chamber, which is configured to be moved from a storage position to a deployed position where the patient may be treated.

It should be understood that the energy supply system of the present invention may be used to supply energy to a variety of devices or systems, including: a DVT device; air inflated mattress or pillow; air inflated siderail; a hose delivering temperature controlled air to dry off patient after bathing or accidental urination; air activated blood pressure cuff; an air activated massage device, including integrated or external devices, for massaging various parts of the body (e.g. legs) for comfort or other reasons (e.g. decubitus care); a suction hose for urine collection, such as on a fighter jet; air inflated body for rotation; "air bag" style system to mitigate patient falls; suction activated wound drainage; devices for irrigation of wounds; suction activated waste evacuation devices; air powered instruments for other purposes (air tools, air activated pumps, etc.); passive motion exercising (e.g. gatch) actuators; patient ventilators complete with filtered and pressure controlled air; patient motion sensing system; air chamber, zoned, patient bed exit system; body lift devices, such as an air inflated fowler device; air inflated segmented body lift (rotate) for wound care access (e.g. decubitus ulcers); air mattress system to enable a lift for X-ray film insertion; air activated peristaltic patient transfer/repositioning (boost) system; air filled gravity assist (ramp) patient transfer aid device; an inflatable patient chamber for uses such as biohazard isolation chamber with filtered air intake/exhaust; a chamber for treatment gases; an inflatable patient chamber for highly concentrated oxygen delivery for improved healing (hyperbaric chamber); bead filled patient immobilization device; portable, disposable fluid containment; air filled pad with ability to do air flotation patient transfers (air hockey); air filled pad delivering treatment gas, such as high oxygen content air or other beneficial substances, such as atomized drugs or other treatments (such as disclosed in U.S. provisional application Ser. No. 60/955,735, filed Aug. 14, 2007, entitled DRUG DELIVERY SYSTEM, which is incorporated by reference herein in its entirety, to promote healing; an air filled pad with temperature controlled air for patient warming or cooling; air filled pad with temperature controlled (hot/cold) air escaping toward the patient to prevent or cure decubitus ulcers, body temperature control, or just for comfort; an inflatable bathtub system for in-bed bathing, for chemical decontamination or for other specialized treatments; and a portable/disposable fluid containment device, for example.

Consequently, the present invention provides a patient support with universal application that can power or energize a variety of devices or deliver fluid to a device or to the patient to provide continuous care for a patient regardless of the condition of the patient or the location of the patient support.

These and other objects, advantages, purposes, and features of the invention will become more apparent from the study of the following description taken in conjunction with the drawings.

BRIEF DESCRIPTION OF DRAWINGS

The detailed description particularly refers to the accompanying figures in which.

DETAILED DESCRIPTION OF THE INVENTION

Figure 1:
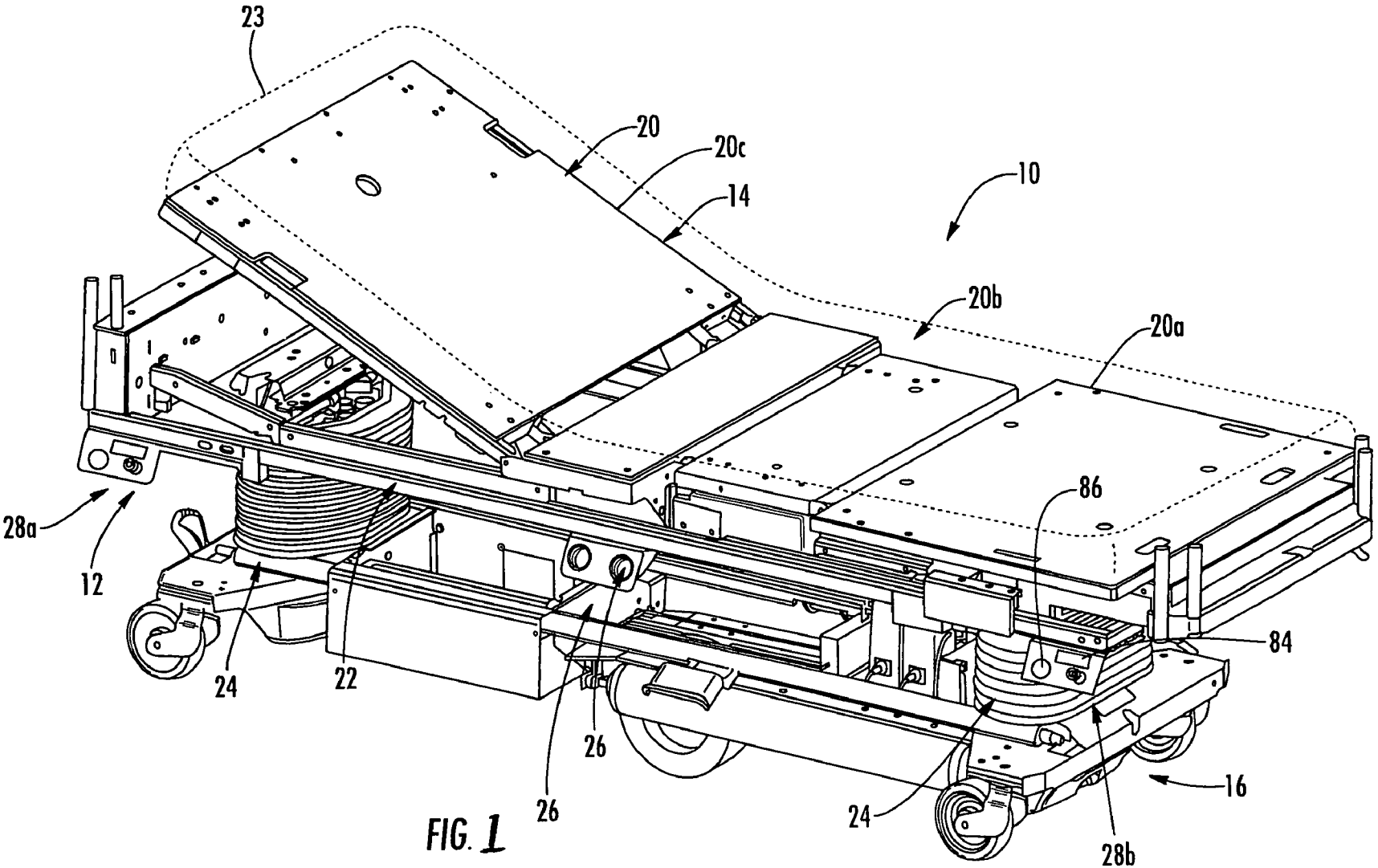
FIG. 1 is a perspective view of a patient support in the form of a hospital bed incorporating a universal energy supply system of the present invention.

Referring to FIG. 1, the numeral 10 generally designates a patient support of the present invention. As will be more fully described below, patient support 10 incorporates a universal energy supply system 12, which delivers fluid or vacuum pressure to a plurality of discrete locations provided at the patient support so that various devices may be powered, actuated, used as a conduit, or the like at the patient support by the fluid or vacuum or so that a fluid or vacuum may be provided for treating or handling the patient. Further, universal energy system 12 may provide high pressure/low volume fluid or high volume/low pressure fluid, and further warmed or cooled fluid. The vacuum or fluid supply may be external to the patient support, with the energy supply system acting merely as a conduit and control system for the fluid or vacuum pressure. Alternately, or in addition, the universal energy supply 12 may have its own supply of vacuum pressure or fluid, which is provided at the patient support to provide a self-contained energy supply system so that a patient that is supported by the patient support can receive continuous care even when the patient support is disconnected from an external supply of fluid or vacuum. In addition, the electrically powered components of the system may be located beneath the patient support surface or at an underside of the patient support surface, with some for example, located in the base of the patient support, while the ports may be located at the patient support surface, which provide power without the attendant risks associated with electrical power. Further, the universal energy system therefore may provide energy in one form that can then be transformed into another form of energy, such as mechanical or pneumatic energy.

In the illustrated embodiment, patient support 10 comprises a bed; however, it should be appreciated that patient support 10 may comprise other patient supports including, for example stretchers, cots, surgical tables, chairs, such as treatment recliners, physical therapy tables, wheel chairs, or the like. For ease of description, the following description will be made in reference to a bed, though it should be understood that the invention is not so limited. Further, the present invention may be incorporated into different types of beds, including a hospital bed, a long term facility care bed, or a bed in a home.

Figure 2:
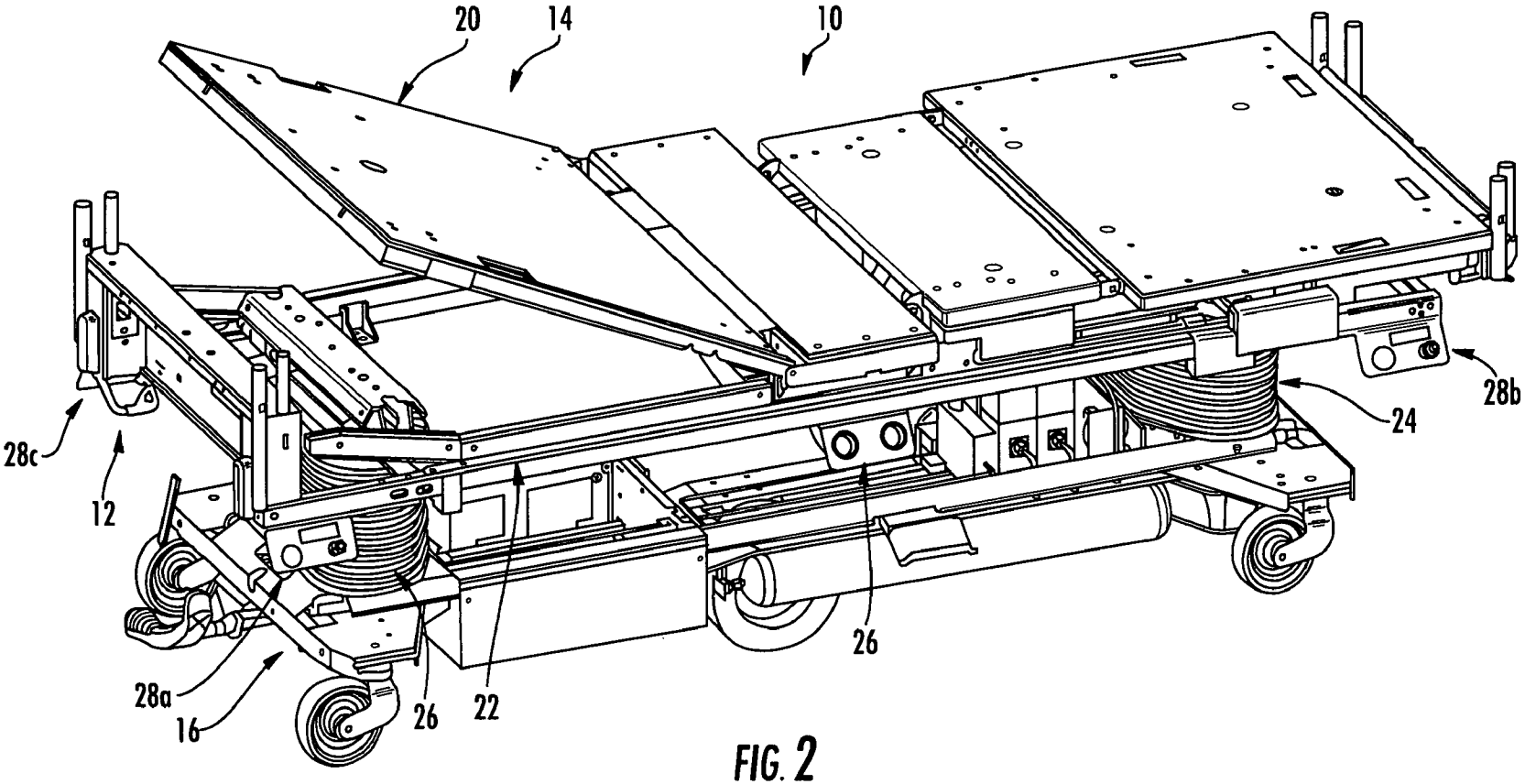
FIG. 2 is a second perspective view of the patient support of FIG. 1.

As best seen in FIGS. 1 and 2, patient support 10 includes a support surface 14 that is mounted to a base 16. In the illustrated embodiment the base is a wheeled base supported on a plurality of casters; however, it should be understood that the patient support may include a fixed base, for example, in the case of a OR table. Support surface 14 includes an articulating deck 20, with a foot section 20*a*, a seat section 20*b*, and a head section 20*c*, which are supported by an intermediate frame 22. Support surface 14 further includes a mattress 23, which may comprise a foam mattress or mattress with bladders or a combination of both. For examples of suitable mattresses that may be supported on the deck, reference is made to U.S. Pat. No. 5,179,142 and copending applications U.S. patent application Ser. No. 12/063,970, filed Feb. 15, 2008, entitled MOVEABLE SIDERAIL APPARATUS FOR USE WITH A PATIENT SUPPORT APPARATUS; Ser. No. 11/940,995, filed Nov. 15, 2007, entitled A PATIENT SUPPORT SURFACE WITH TURN-ASSIST; Ser. No. 11/939,829, filed Nov. 14, 2007, entitled A PATIENT SUPPORT SURFACE WITH TURN-ASSIST; and Ser. No. 11/381,631, filed May 4, 2006, entitled VIBRATING PATIENT SUPPORT APPARATUS WITH A RESONANT REFERENCING PERCUSSION DEVICE, which are commonly owned by Stryker Corporation of Kalamazoo, Mich. and incorporated by reference in their entireties herein. Further, for a maternity bed, a suitable mattress may include a mattress described in U.S. provisional patent application Ser. No. 60/920,381, filed Mar. 28, 2007, entitled MATERNITY BED AND PATIENT LYING SURFACE THEREFOR, which is commonly owned by Stryker Corporation of Kalamazoo, Mich. and incorporated by reference in its entirety.

Intermediate frame 22 is movably mounted to base 16 by a pair of lift mechanisms 24 so that the support surface may be raised or lowered as desired. Suitable lifting devices for the frame include mechanical lifting devices, including screw lifts, or hydraulic jacks or cylinders, such as disclosed in U.S. Pat. Nos. 5,172,442; 6,820,294; and 7,150,056, which are commonly owned by Stryker Corporation of Kalamazoo, Mich. and which are incorporated by reference in their entireties herein. Further, the head and foot deck sections may be raised or lowered using actuators, such as disclosed in copending application Ser. No. 11/612,428, filed Dec. 18, 2006, entitled HOSPITAL BED; Ser. No. 11/612,405, filed Dec. 18, 2006, entitled HOSPITAL BED; Ser. No. 11/642,047, filed Dec. 19, 2006, entitled HOSPITAL BED; and Ser. No. 11/612,361, filed Dec. 18, 2006, entitled HOSPITAL BED, all commonly owned by Stryker Corporation of Kalamazoo, Mich. and which are incorporated by reference herein in their entireties. It should be understood that energy supply system 12 may be incorporated into patient supports that have fixed patient surfaces as well as fixed bases, as noted above.

Referring again to FIGS. 1 and 2, energy supply system 12 includes a plurality of ports 26, 28*a*, 28*b*, 28*c*, and 28*d*, which are mounted at discrete locations at patient support 10, such as at or near the four corners of patient support 10, for providing a fluid or vacuum pressure at one or more ports. In this manner, the ports are provided at spaced locations around the patient support surface so that a user, such as a caregiver or patient, can access the energy supply system from either side or either end of the patient support. Further, it should be understood that multiple ports can be provided at each location to provide separate ports for fluid delivery and for the vacuum pressure.

Ports 26, 28*a*, 28*b*, 28*c*, and 28*d* are adapted to couple to various devices, which are either powered or actuated by the fluid or vacuum or which provide a conduit for the fluid or vacuum for delivering the fluid or vacuum to another location on the bed, including to the patient and/or the patient support surface. For example, a conduit, such as a flexible hose, may be coupled to any one of the ports to deliver the fluid or vacuum to another device, such as nozzle, a DVT device, an irrigation tool, such as a lavage device, which is used for debridement of a wound, or to the mattress or the like, as will be more fully described below.

Figure 6:
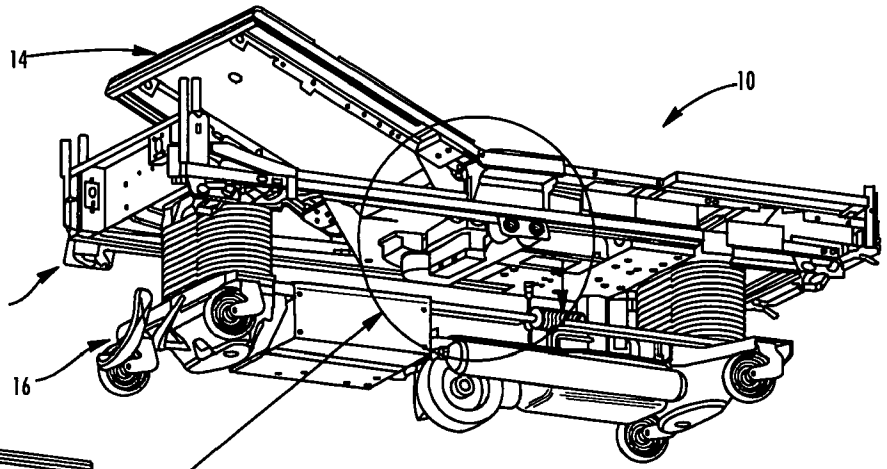
FIG. 6 is a second bottom perspective view of the patient support of FIG. 1.
Figure 7:
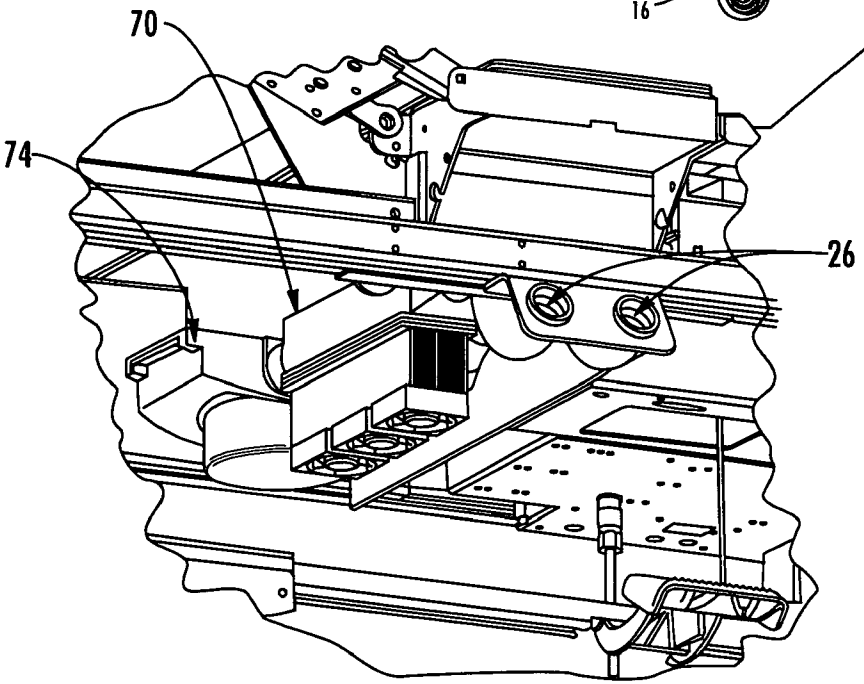
FIG. 7 is an enlarged perspective fragmentary view of the patient support of FIG. 6 illustrating the heating and cooling portion of the universal energy supply system.
Figure 8A:
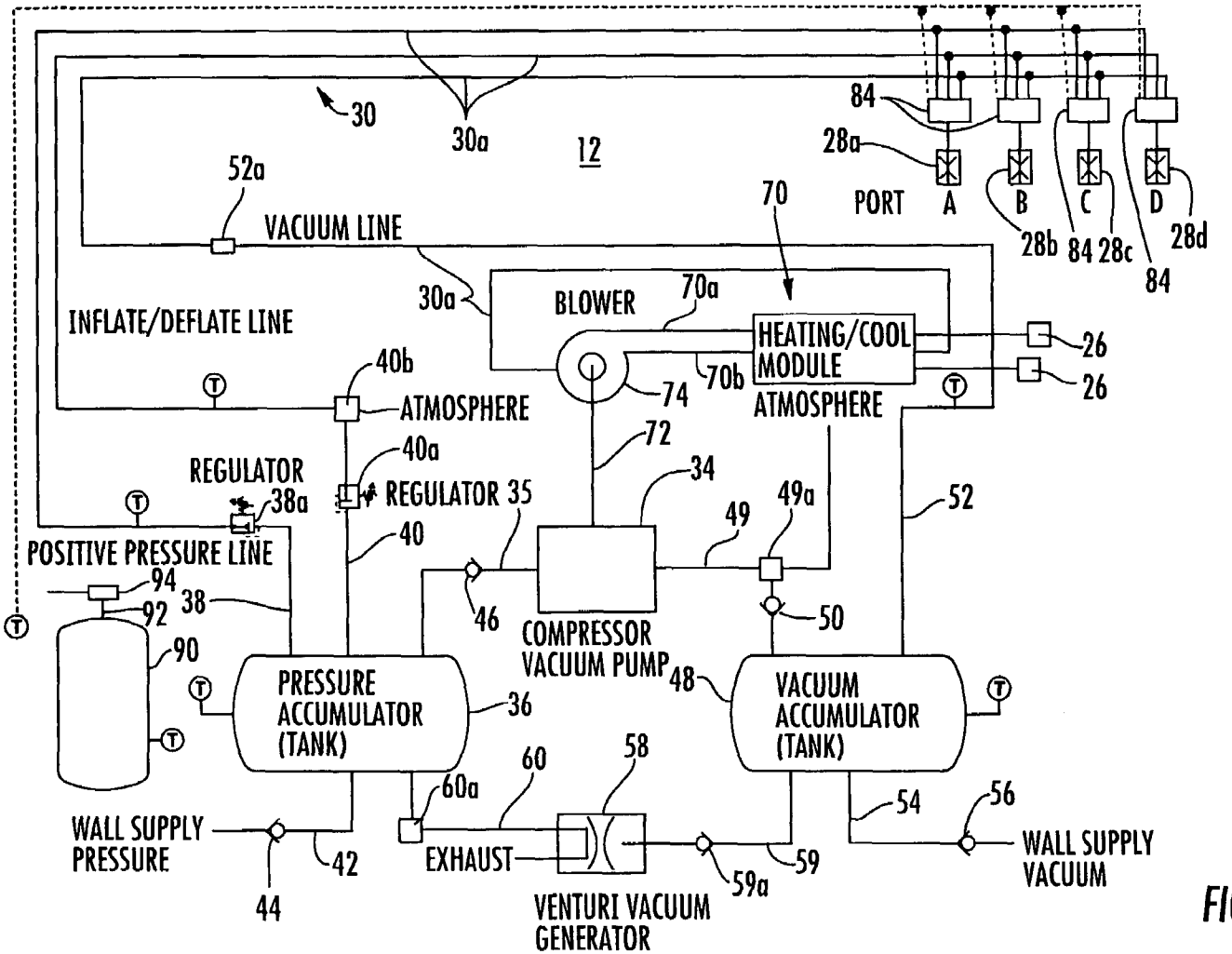
FIG. 8A is a schematic drawing of the universal energy supply system of the present invention.
Figure 8B:
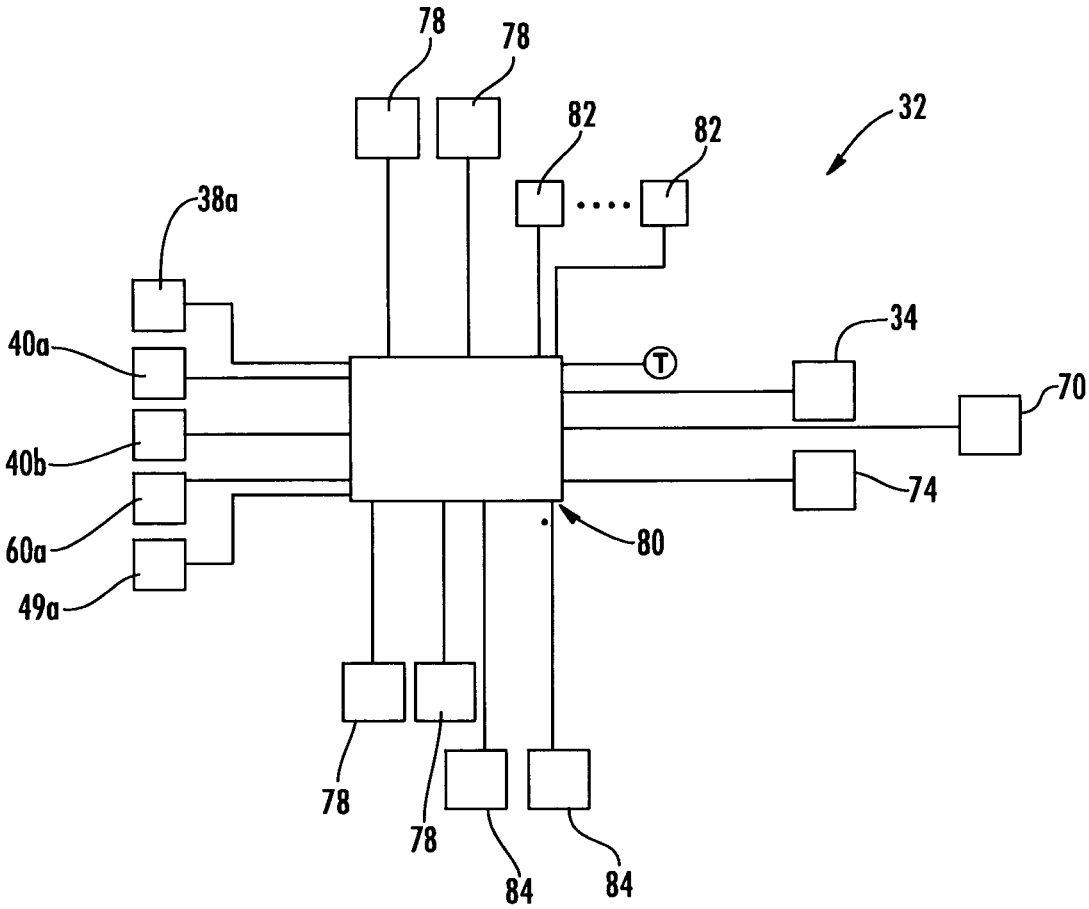
FIG. 8B is a schematic drawing of the control system of the universal energy supply system of the present invention.

Referring to FIGS. 3-7, energy supply system 12 includes a fluid movement system 30 and a control system 32 (FIG. 8B). Control system 32 controls fluid movement through fluid movement system 30 and, further, the fluid movement at the respective ports. Fluid movement system 30 includes tubing or conduit 30*a* that is in fluid communication with a fluid supply (either an onboard supply or an external supply or both) and is in selective fluid communication with the respective ports 26, 28*a*, 28*b*, 28*c*, and 28*d* to selectively deliver fluid or vacuum pressure to the respective ports. In the illustrated embodiment, tubing 30*a* comprises a three-cannula tube to provide three conduits or lines, namely a pressure line (38), an inflate/deflate line (40), and a vacuum line (52) (FIG. 8A). A fourth conduit or line may also be provided to deliver treatment fluid, such as a liquid or atomized liquid, to any one of or all the ports to allow treatment fluid to be delivered to a device or patient, also more fully described below. It should be understood that separate tubes may be run for each line and, further, additional lines or cannulae may be provided, for example, to provide additional conduits, such as a gas line, including as noted a treatment fluid or gas line, for example an oxygen line, more fully described below.

Figure 3:
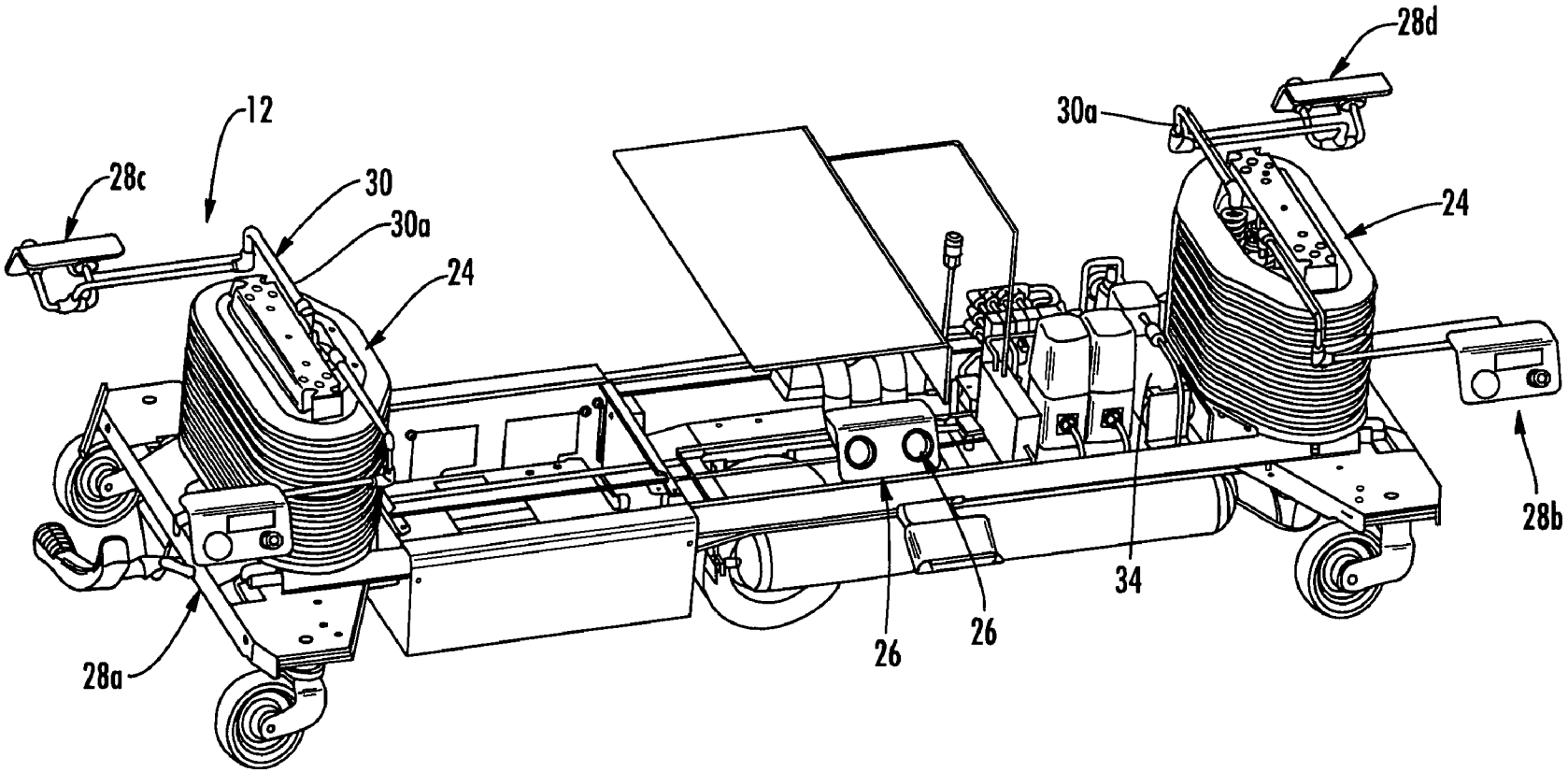
FIG. 3 is a perspective view of the patient support of FIGS. 1 and 2 illustrating the universal energy supply system with the patient support surface removed for clarity.
Figure 4:
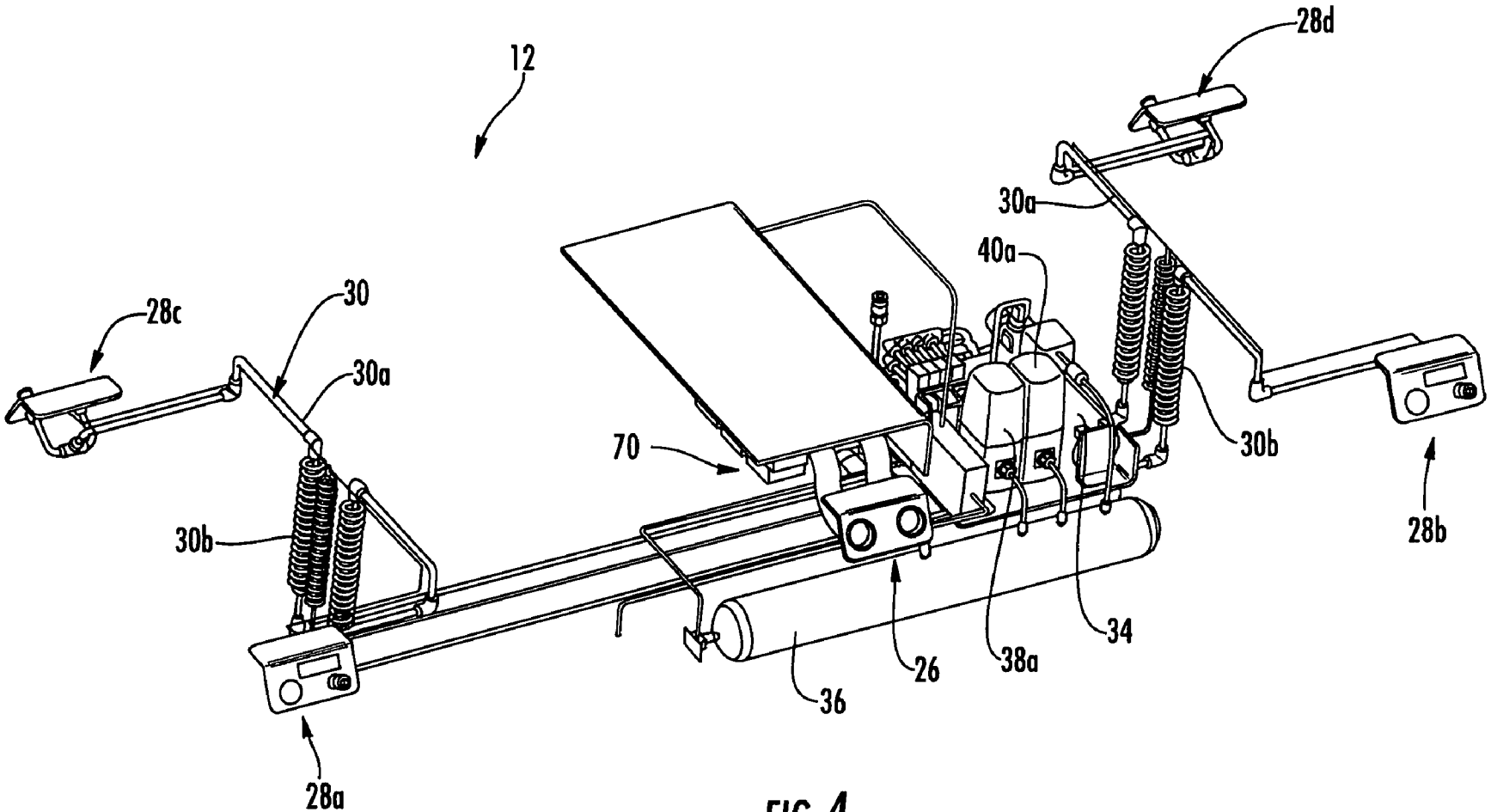
FIG. 4 is a perspective view of the universal energy supply system of FIG. 3.
Figure 5:
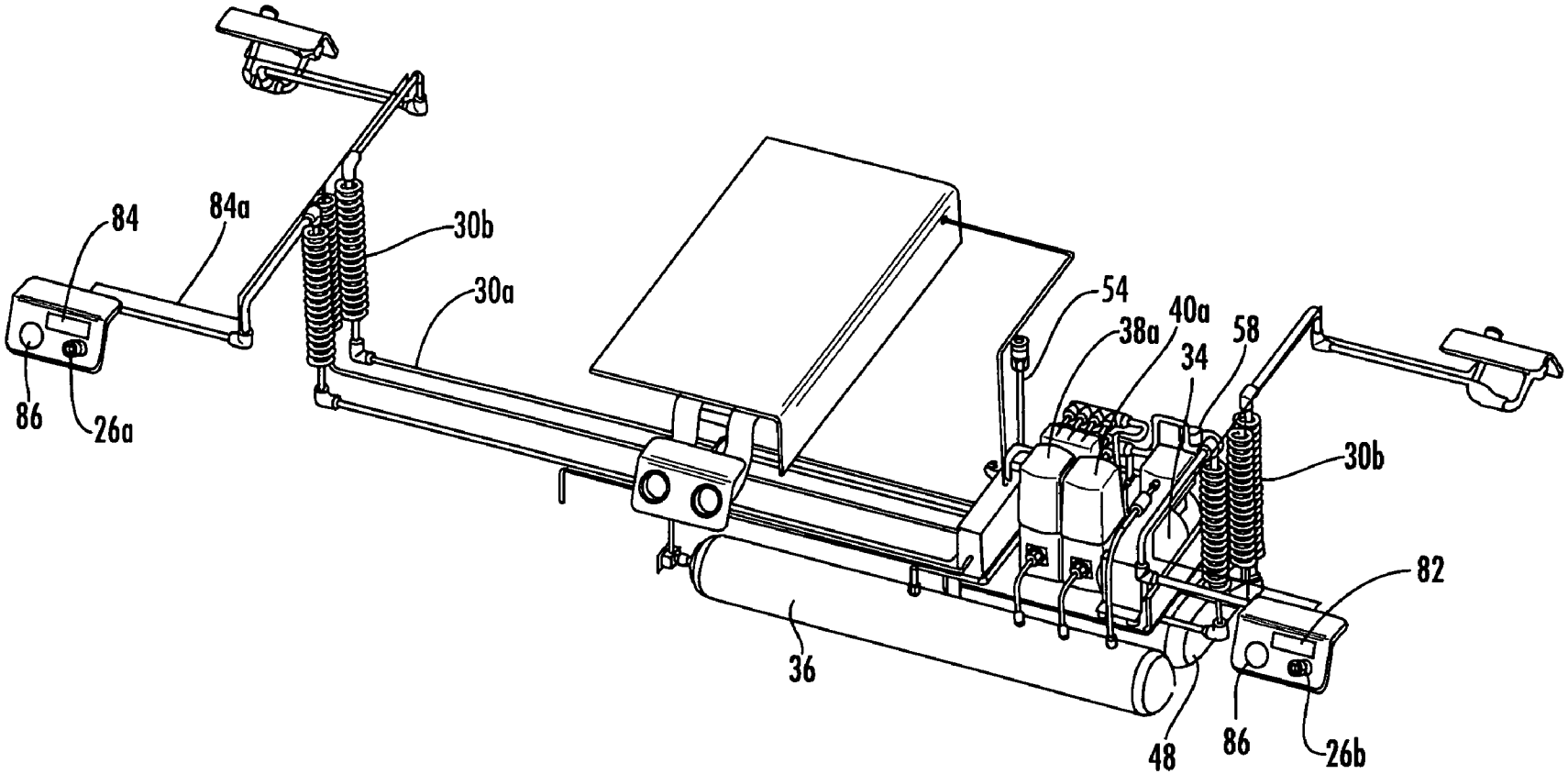
FIG. 5 is another perspective view of the energy supply system of FIG. 4.

As best seen in FIG. 3, tubing 30*a* runs through the patient support, and is supported at various points, for example in the base 16, and further extends through the respective lift assemblies 24 and thereafter extends to the respective ports 28*a*-28*d* and 26. To accommodate the vertical movement of the patient surface relative to the base, tubing 30*a* may include coiled sections 30*b*, which accommodates the relative movement of the lower portion of the tubing relative to the upper portion of the tubing resulting from any adjustment in height of the patient support surface relative to base 16.

In the illustrated embodiment, fluid movement system 30 may operate as a fluid delivery system, including a high pressure/low volume or a high volume/low pressure, and/or as a vacuum system. As used herein, the term "fluid" includes liquid and/or a gas, such as air and may include gases, such as treatment gases, for example oxygen, or mixtures thereof, which will be more fully described below. For example, in the illustrated embodiment, ports 28*a*-28*d* may be configured to deliver high pressure/low volume fluid or a vacuum pressure, while ports 26 may be configured to deliver low volume/high pressure fluid.

Again referring to FIG. 3, fluid movement system 30 optionally includes a compressor/vacuum pump 34, which delivers pressurized air to a pressure accumulator 36. The compressor/vacuum pump may be onboard, as noted, or may comprise an external compressor/vacuum pump, which delivers pressurized air (or a vacuum as noted below) to a pressure accumulator 36. Pressure accumulator 36 is in fluid communication with pressure line 38 and an inflate/deflate line 40, which are respectively in fluid communication with respective ports 28*a*-28*d*. The flow of fluid through lines 38 and 40 is controlled and regulated by pressure regulators 38*a* and 40*a*, respectively, which are also controlled by control system 32. Further, pressure accumulator or tank 36 includes a conduit or line 42 for coupling to a wall supply pressure through a check valve 44. As noted, the compressor may be external to the patient support and may be coupled to the wall supply pressure.

Compressor/vacuum pump 34 is in fluid communication with pressure accumulator 36 through a check valve 46 and also in communication with a second tank or vacuum accumulator 48 through conduit or line 49 and through check valve 50. Tank 48 is in fluid communication with vacuum line 52, which is in selective fluid communication with respective ports 28*a*-28*d* to provide vacuum pressure at the respective ports and so that a vacuum pressure may be selectively provided at the respective ports. Again, as noted above, the compressor/vacuum pump may be on board or external to the patient support.

In addition, vacuum accumulator 48 optionally includes an external vacuum line 54, which is in fluid communication with a wall supply vacuum through a check valve 56. In this manner, both the fluid delivery system and the vacuum system may be coupled to sources external to the bed so that the energy supply system can be hooked up to, for example, a wall pressure supply or a wall vacuum supply when patient support 10 is in, for example, a hospital room. As will be more fully described below, in addition to an onboard fluid supply (tank 36), patient support may also incorporate an onboard vacuum generator.

As noted above, the vacuum pressure may be supplied by a wall vacuum supply or an onboard supply. As best seen in FIG. 8, vacuum accumulator 48 may be in fluid communication with a venturi vacuum generator 58 through line 59 and check valve 59*a*. Vacuum generator 58 generates a vacuum pressure using a venturi effect generated by an exhaust line 60 that extends off tank 36. In this manner, when patient support 10 does not have access to an external vacuum supply, such as a wall vacuum supply commonly found in a hospital room, patient support 10 may still provide the necessary vacuum pressure to provide continuous care to the patient even though the patient support 10 may be in transit or not located near an external source.

As would be understood, therefore, ports 28*a*-28*d* may provide fluid in the form of a negative pressurized fluid (such as a vacuum pressure) or in the form of a positive (high or low) pressurized fluid, which, as noted above, may be used to power one or more devices at the patient support for the care, handling, treatment or monitoring of a patient supported at patient support 10. Further, in order to control the pressure in the respective lines of fluid movement system 30, control system 32 includes sensors, for example pressure transducers T, that may be provided at various locations, such as at tanks 36, 48, at lines 38, 40, and 52 and also at supply tank 90 and line 92 (FIG. 8). Sensors (T) are in communication with controller 80 of control system 32, which monitors the pressure at the various locations to provide pressure feedback for system 32.

In addition, energy supply system 12 may incorporate a heating and/or cooling device 70 for heating or cooling the fluid in fluid movement system 30. In the illustrated embodiment, fluid is delivered from compressor 34 through a conduit 72 to a blower 74, which circulates the fluid through the heating and/or cooling device 70, which either heats or cools the fluid. In this section of the fluid movement system, the conduits may have increased diameters to facilitate the transfer of heat to the fluid, which forms a high volume/low pressure fluid supply. To access this lower pressure/high volume supply of warm or cold fluid, ports 26 are provided at frame 22 and coupled to and in fluid communication with the respective warm and cool lines, which also provide connections for various devices to the patent support. It should be noted that the blower may be similarly be provided external to the patient support.

As best seen in FIGS. 6 and 7, blower 74 and heating and/or cooling device 70 may be supported beneath patient support surface 14, and, as best understood from FIG. 3, compressor/vacuum pump 34, pressure accumulator 36, and pressure regulators 38*a* and 40*a* are all supported at base 16. Hence all the high voltage components are located beneath or below the patient support surface. While configured to be powered from a 110-volt supply, for example, a conventional electrical outlet, the electrical components of the energy supply system may be powered from the bed voltage supply, such a battery, including a rechargeable battery, and further by way of a toroid, such as disclosed in copending application entitled, Ser. No. 11/612,428, filed Dec. 18, 2006. As would be understood therefore, although the energy system is powered by electricity, the power supplied at the patient support surface may be in a non-electrical form and, hence, reduces the risk of exposing the patient to electrical contact while still providing power.

Devices that may be coupled to the respective ports include inflatable devices, such as air inflated mattresses or pillows or pads, including an air inflated fowler, an air inflated segment body lift for rotating a patient to provide wound care access, an air mattress system to enable a lift for an X-ray film insertion, an air filled gravity assist ramp that assists in transferring the patient, an inflatable patient chamber, which can be used as a biohazard isolation chamber with filtered air intake/exhaust, an inflatable patient chamber for treating a wound or for simply applying a medication or drug topically through the tissue, such as skin or an open wound, applying treatment gas (such as highly concentrated oxygen for improved healing, such as in hyperbaric chamber) or a vacuum or other beneficial substances, such as a drug or the like to a patient, an air filled pad to create an air flotation patient transfer device, an air filled pad that may be used to deliver or apply treatment gas, for example, oxygen, or other beneficial substances or a vacuum to treat a wound or other condition to promote healing (like a hyperbaric chamber), an air filled pad with temperature controlled air for patient warming or cooling, an air activated cuff, an air filled pad with temperature controlled air escaping to the patient to prevent or cure decubitus ulcers, body temperature control, or just for comfort, an air inflatable bathtub system for in-bed bathing for chemical decontamination or for other specialized treatments, an inflatable chamber used for cleaning a patient's wounds such as by a lavage device, or an air inflated side rail, or the like.

As noted above, the energy system of the present invention may be used to power the patient surface, in the form of supplying air. For example, the energy support system 12 may supply pressurized air to a sequential valve system or to a pressure mapping feed back system for sequential inflation or deflation of the surface, such as a DVT device. Further, this may be done manually or automatically. As noted above, the patient surface may comprise a multiple segment mattress and/or include one or more inflatable bladders for turning the patient, for applying vibration and/or percussion treatment to prevent bed sores, to provide respiratory treatment, for retarding development of decubitis ulcers, or the like, such as disclosed in U.S. Pat. No. 5,179,142 and copending U.S. patent application Ser. No. 12/063,970, filed Feb. 15, 2008, entitled MOVEABLE SIDERAIL APPARATUS FOR USE WITH A PATIENT SUPPORT APPARATUS; Ser. No. 11/940,995, filed Nov. 15, 2007, entitled A PATIENT SUPPORT SURFACE WITH TURN-ASSIST; Ser. No. 11/939,829, filed Nov. 14, 2007, entitled A PATIENT SUPPORT SURFACE WITH TURN-ASSIST; and Ser. No. 11/381,631, filed May 4, 2006, entitled VIBRATING PATIENT SUPPORT APPARATUS WITH A RESONANT REFERENCING PERCUSSION DEVICE; and U.S. Pat. No. 5,325,551, or for delivery of warm to a patient warming apparatus incorporated into the surface, such as disclosed in U.S. Pat. No. 5,251,347, all commonly owned by Stryker Corporation of Kalamazoo, Mich., and all of which are incorporated by reference in their entireties herein.

For example, when energy supply system 12 is used to supply air to the inflatable bladders described in the vibration/percussion treatment surfaces referenced above, high volume/low pressure air or high pressure/low volume may be directed into the surface. When high pressure/low volume air is supplied, the pump described in the referenced patent and applications therefore may be eliminated provided that sufficient air pressure is supplied by the energy supply system 12 to the manifold, which delivers the air to the respective bladders. Similarly, the pump in U.S. Pat. No. 5,325,551 may also be eliminated provided sufficient air pressure may be supplied. With reference to the patient heating apparatus, the blower and/or heater may be eliminated should the air flow and temperature control provided by energy supply system 12, for example through ports 26, be sufficient.

As noted above, energy supply system 12 may also be configured to supply treatment fluid, such as fluid with a drug. It should be understood that the term "drug" is used broadly to include pharmaceuticals, including pain killers, such as opiates or steroids; hormones, such as androgens and estrogens, peptide hormones such as insulin, as well as performance enhancing drugs, such as steroid hormones; proteins, including morphogenetic proteins, such as bmp-2 and bmp-7; nutrients; antibiotics, such as tetracycline, penicillin, amoxicillin, erythromycin, for example; herbal medicine; vitamins; or other treatments. Further, when using the term "drug" or "drugs" it should be understood that this also includes any carriers, such as solvents or excipients, which may be added to the drug to aid in the delivery of the drug as well as enhance penetration or efficacy of the drug. For further details of how the drug may be delivered and applied using a topical pad or chamber, reference is made herein to copending application entitled DRUG DELIVERY SYSTEM, filed on Aug. 14, 2007, Ser. No. 60/955,735, which is herein incorporated by reference in its entirety.

Other devices that may be mounted or coupled to the ports include delivery mechanisms, such as conduits, or air powered instruments, such as air powered tools or air activated pumps, etc. For example, the high pressure/low volume air supplied by energy supply system 12 may be used to drive the impeller on an air powered device, such as a tool or drive piston driven device to thereby power the device. In this manner, the energy from energy supply system 12 is transformed into mechanical energy. These devices may be directly coupled to the port or may be coupled to the port via a conduit. Conduits may be coupled to a port to deliver fluid or a vacuum pressure to another device or simply direct the fluid or vacuum to an applicator, such as a nozzle, including a lavage device, or direct the fluid or vacuum directly to the patient for treatment or care. For example, healing liquids or gases (such as liquids or gases, including medication or drugs, including liquids or gases with antibacterial properties or cell regeneration properties) may be directed to the patient using a conduit. Other applications include: suction hoses for urine collection, a conduit for delivering temperature controlled air to dry off a patient after bathing or accidental urination, air activated external message device for various parts of the body for comfort and other reasons (e.g. decubitus care), a conduit for suctioning waste, a conduit for use as a power source for irrigation of wounds, a conduit for delivering air for use as a patient ventilation system, or the like.

Further, control system 32 is optionally adapted to detect the presence of a device either when the device is coupled to the port or when the device is in close proximity to the port. For example, close proximity to the port may include the device being within a range of 0-12 inches, or 0-6 inches, or 0-3 inches to the port. Each port **28*a*-28*d* may include a sensor, such as an RFID reader 78, which reads an RFID tag applied to the respective device. The RFID tag may contain an identification code for the device or contain information about the device, for example, the pressure requirements to operate the device, such as minimum pressure requirements and/or maximum pressure requirements. In this manner, based on the information conveyed by the RFID tag, control system 32 may determine the appropriate pressure needed for the device (such as by a look-up table stored in the control systems memory device, which may include one or more parameters for a plurality of devices or simply based on the information provided by the tag) and then adjust the pressure of the system and deliver the appropriate pressure to the port to which the device is attached. Alternately, control system 32 may be configured to supply pulsed fluid or a steady stream of fluid so that the control system 32 may be used to control the device rather than just simply providing energy in the form of pressurized fluid to the device and with the device controlling the use of the fluid. Consequently, the control system 32 may be configured control the device and determine how the device will operate. In other words, a device may be coupled to the energy supply system with its output controlled by the control system 32**.

As noted, control system 32 controls the level of pressure in the fluid movement system 30. As noted above, each of the positive pressure line 38 and the inflate/deflate line 40 includes a respective regulator 38*a*, 40*a* that is in communication with and controlled by control system 32, which includes a central controller or central processing unit 80. Controller 80 is in communication with the regulators as well as the respective RFID readers 78 provided at the ports. In this manner, when the RFID reader reads the RFID tag of the respective device, the RFID reader, which is in communication with the central processing unit 80, will generate a signal that indicates the identification of the device or a pressure range or pressure required by the respective device. In turn, the controller (80) will adjust the pressure in the appropriate line (38 or 40) through regulators 38*a* and 40*a* to provide an automatic system. For example, controller 80 may be mounted adjacent one of the ports or may be mounted in the base, a siderail, a footboard or a headboard.

Alternately or in addition, control system 32 may provide for manual input. For example, controller 80 may be coupled to a user input device, such as a keypad, touch screen or the like, so that a user, such as a healthcare provider, may select which port is to be used and to input the type of device that is to be coupled to the port. This may be achieved through the use of an icon, for example, an icon for each port, and/or through the use of a menu, for example a menu of the ports and/or a menu for devices that may be coupled to the ports. Further, the user input device may include buttons, such as a keypad, to allow the user to select the pressure, the type of flow, e.g. pulsed flow or constant flow, the frequency of the pulsed flow, or a profile for the pulse flow. In addition, the user input device may allow the user to select a duration for the flow of fluid or the temperature of the fluid. For example, the user input may be located at or near one of the ports and/or located in a siderail, headboard or footboard. Examples of suitable user input devices and examples of suitable buttons, menus, and touch screen displays that may be used to provide a user interface, reference is made to copending application Ser. No. 11/612,428, filed Dec. 18, 2006, entitled HOSPITAL BED; Ser. No. 11/612,405, filed Dec. 18, 2006, entitled HOSPITAL BED; Ser. No. 11/642,047, filed Dec. 19, 2006, entitled HOSPITAL BED; Ser. No. 11/612,361, filed Dec. 18, 2006, entitled HOSPITAL BED; and Ser. No. 11/941,338, filed Nov. 16, 2007, entitled PATIENT SUPPORT WITH IMPROVED CONTROL, all commonly owned by Stryker Corporation of Kalamazoo, Mich. and which are incorporated by reference herein in their entireties.

Alternately, pneumatic-based user interfaces may be used. For example, air buttons that actuate switches using air, such as "sip& puff" controls, may be used to select functions or to control the operation of devices coupled to the ports via the controller. These controls may provide simple on/off functions or may provide selections between a menu of functions. Further, voice activated controls may be incorporated into controller 80 so that the user may simply command the controller what functions are to be performed. Additionally, remote control may used to control controller 80. For example, controller 80 may be coupled using a link to a remote nurse's station or to a remote location, including a remote location that is remote from the hospital or institution where the patient support is located. The link may be a hardwired link, such as an RS 232 cable, or a wireless link, including radio frequency or infrared frequency wireless transmission, in which case controller 80 would include a receiver or a transceiver to allow the wireless communication. For example, where the energy supply system supplies fluid, for example, to a ventilator, the supply of fluid to the ventilator may be controlled remotely via controller 80. Further, a datalink between the ventilator and the controller maybe provided, which transmits data from the ventilator to the controller 80, so that the ventilator may be remotely monitored and controlled.

As noted above, the devices that may be included at a patient support include hyperbaric treatment devices or vacuum assist closure devices, including hyperbaric or vacuum assist closure chambers, which may be inflatable devices, and, further, which may be incorporated into the patient support described more fully below. For example, suitable hyperbaric or vacuum assist closure devices are described in U.S. Pat. Nos. 5,154,697; 5,636,643; 4,969,880; and 5,645,081, which are incorporated by reference herein in their entireties.

Referring to FIG. 8B, central processing unit 80, which is in communication with pressure regulators 38*a*, 40*a* and RFID readers 78, is also in communication with compressor 34. Further, central processing unit 80 is in communication with valves 40*b*, 60*a*, and 49*a* to control the movement of the fluid through the respective lines. In addition, central processing unit 80 is in communication with displays 82 (FIG. 5), such as LCD display, which may be provided at or near ports 28*a*-28*d* and used to display the type of device that is coupled to the respective port, the pressure being delivered by the system to the respective port, or other information related to the port. In addition, central processing unit 80 is in communication with blower 74 and heating/cooling module 70 to thereby control the heating and cooling of the fluid in fluid movement system 30.

Optionally, system 12 may also include an oxygen supply 90, including an oxygen concentrator, which is in fluid communication with the respective ports 28*a*-28*d* through a line 92 and control valve 94, such a solenoid control valve. Optionally, oxygen can be injected into line 92 to provide an increased oxygen level or may be injected into line 92 to provide at or about 100% oxygen at a selected port for delivery to the patient, for example, through a respirator or for use in a hyperbaric treatment chamber for treatment of a patient's wound, as more fully described below. Controller 80 is therefore also in communication with valves 94 to control the flow of oxygen in line 92. Further, system 12 may incorporate a humidifier in any one of lines 38, 40 and 92, which may be particularly suitable for use with a hyperbaric treatment device or drug delivery device.

In operation, control processing unit 80 controls the pressure in the fluid delivered to the respective port by regulating the pressure through regulators 38*a* and 40*a*. Further, control unit 80 is in communication with control devices 84 at the respective ports, which control whether constant pressurized fluid or an on/off pressurized fluid or oxygen is delivered to the respective port or whether a vacuum pressure is delivered to the respective port. For example, a suitable control device may include a three-way valve in the case of the three line system or a four way valve in the case of a four line system. Suitable three or four way valves include solenoid valves or a solenoid manifold. In this manner, when the central processing unit detects that a device requires a certain pressure at a respective port, the control unit will configure the fluid movement system to supply the appropriate pressure or vacuum at the respective port. Optionally, each port may include a pressure gage 86, which detects and indicates the pressure at the respective port.

Figure 9:
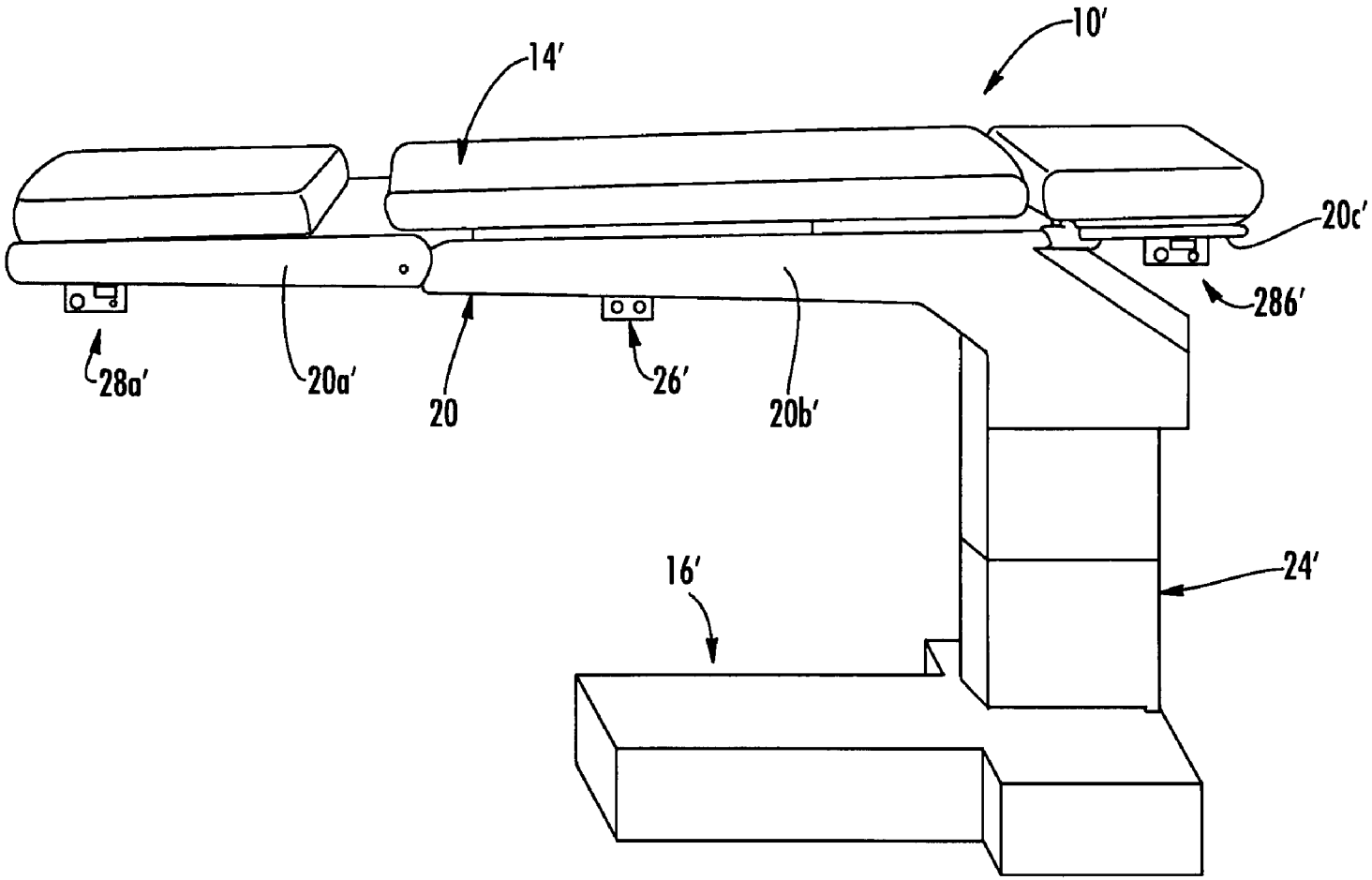
FIG. 9 is a perspective view of an operating table with a fluid movement system of the present invention.

Referring to FIG. 9, the numeral 10' designates another embodiment of a patient support in the form of a surgical or OR table. Patient support 10' similarly includes a support surface 14' that is mounted to a base 16'. Support surface 14' includes a plurality of articulating sections 20', with a foot section 20*a*', a seat section 20*b*', and a head section 20*c*', which are cantilevered from base 16' by a pedestal 24'. Optionally, pedestal 24' is a telescoping pedestal, which allows the patient support surface to be raised or lowered by way of actuators) not shown). Support surface 14' further includes a plurality of pads, such as a leg pad, a torso pad, and a head pad, which may comprise foam pads or pads with bladders or a combination of both.

Mounted at spaced locations around support surface 14' are a plurality of ports 28*a*', 28*b*', and 26', which provide fluid flow, including pressurizing fluid flow or a vacuum pressure, in a similar manner to the ports described above in reference to patient support 10. Ports 28*a*', 28*b*', and 26 are coupled to a fluid movement system and/or a vacuum system, and controlled by a control system similar to the systems described above; therefore, reference is made to the first embodiment for further details of the energy supply system of patient support 10'. IT should be understood that the various component of the fluid movement system and/or a vacuum system maybe similarly supported and located in base 16' and further below the patient support surface 14' to again provide a system that can deliver energy at or near the patient support surface without the attendant risks associated with electrically powered devices.

Figure 10:
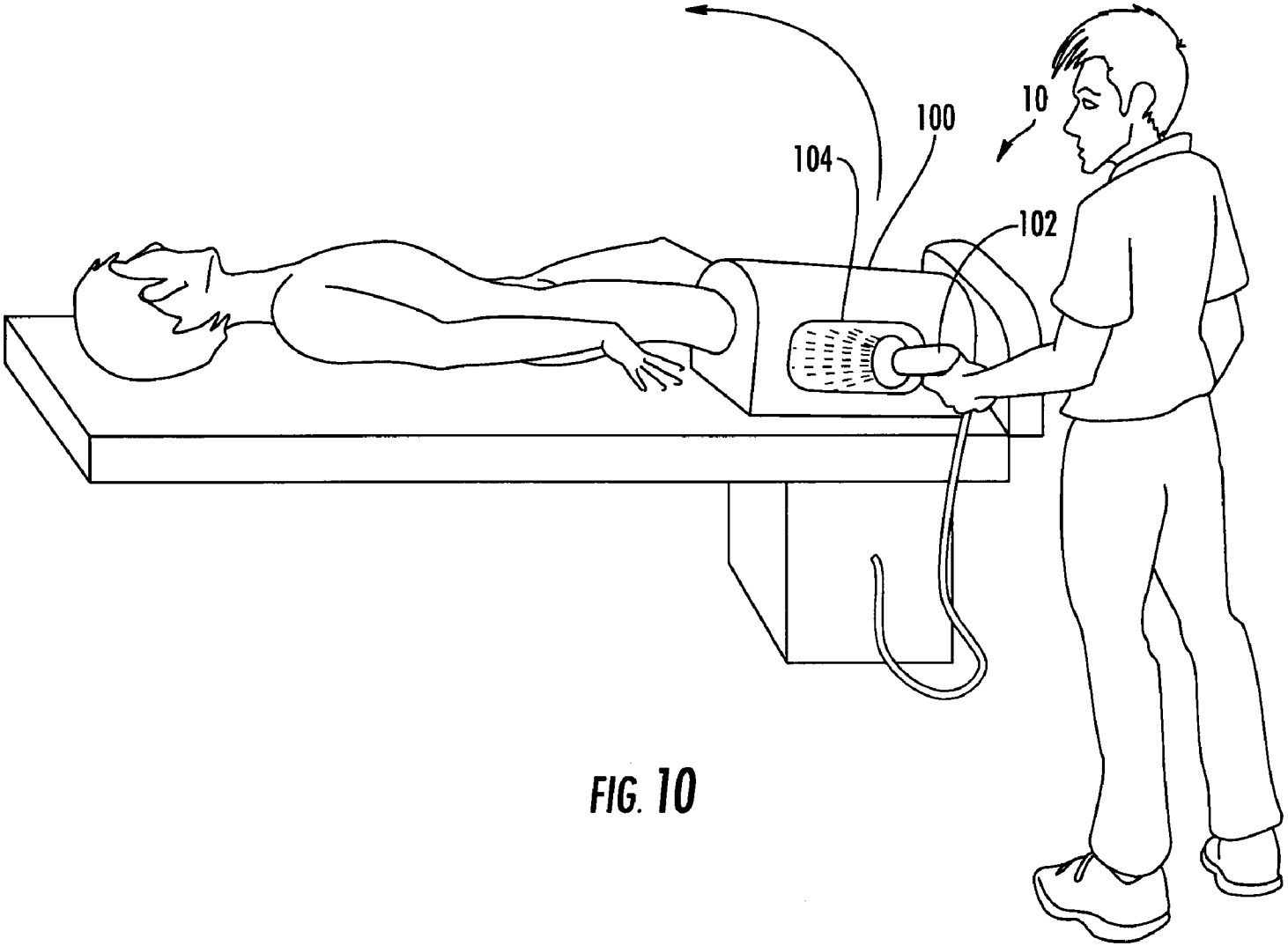
FIG. 10 is a schematic perspective view of a patient support incorporating an inflatable device, such as compartment or tent.

Referring to FIG. 10, as noted above, patient support 10 may power an inflatable device. As best seen in FIG. 10, one example of an inflatable device includes an inflatable chamber or tent 100, which may be provided to form a shield and to retain splashes, for example from an irrigation tool, such as a pulsating lavage device 102. Suitable lavage devices are described in U.S. Pat. Nos. 4,278,078; 6,099,494; and 6,179,807, all commonly owned by Stryker Corporation of Kalamazoo, Mich., which are incorporated by reference in their entireties.

For example, pulsating lavage device 102 may be coupled with one of the ports (28*a*-28*d*) at the patient support 10 and may be used to direct pulsating fluid onto a portion of a patient's body, for example through an opening 104 formed in the chamber 100. Optionally, chamber 100 may incorporate a boot that receives the tip of the lavage device but allows the tip to be maneuvered to properly treat the patient. For example, chamber 100 may be configured to receive a patient's leg or other extremities or the torso of the patient. Further, as noted above, chamber 100 may be coupled to another port on the patient support 10 through a conduit, such as tubing, to provide a source of pressurized air to inflate the chamber.

Figure 11:
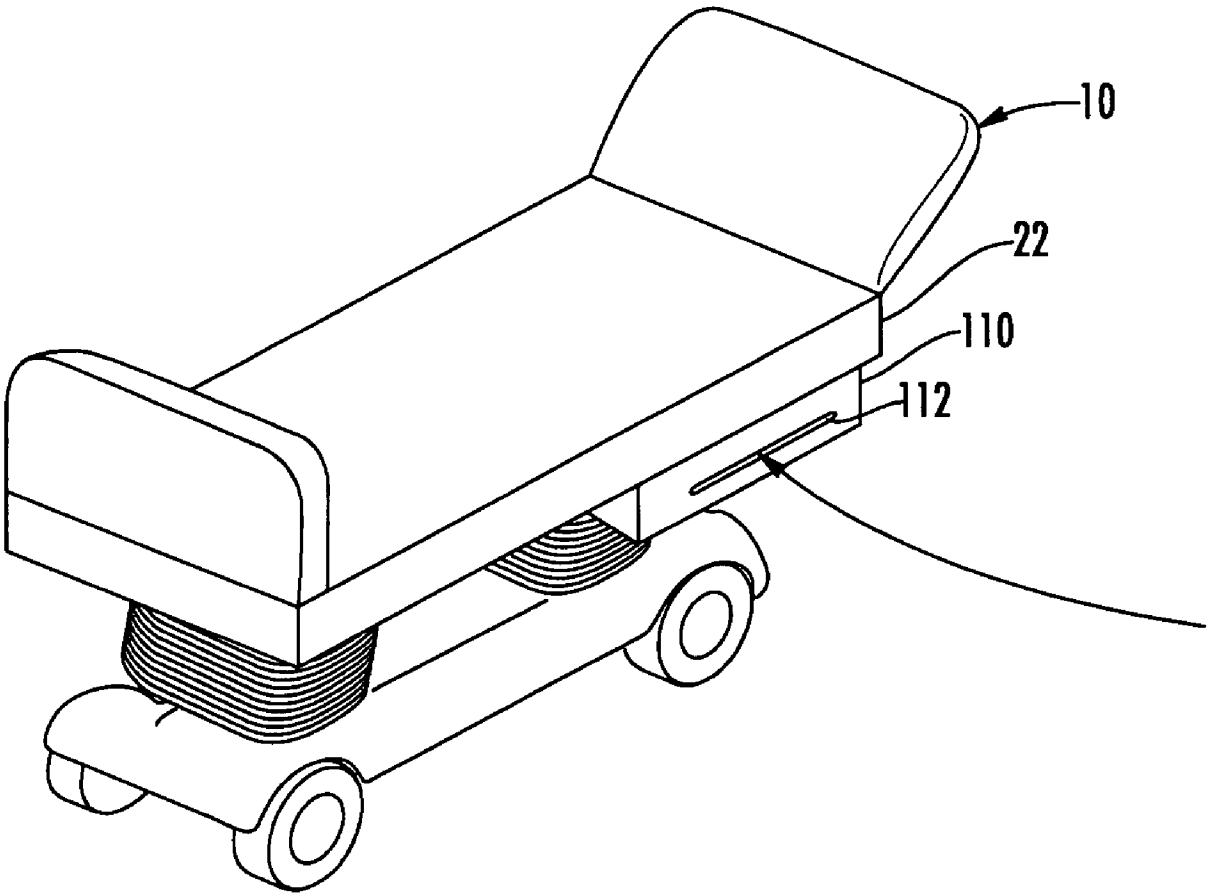
FIG. 11 is a perspective view of a patient support of the present invention incorporating a compartment or housing for holding disposable inflatable devices, such as disposable hyperbaric devices, inflatable vacuum assist closure devices, disposable patient transfer pallets or drug delivery devices.

Referring to FIG. 11, chamber 100 or other inflatable devices, which will be more fully described below, may be incorporated or stored in a housing 110 mounted to patient support 10. For example, housing 110 may be mounted beneath the intermediate frame 22. Housing 110 optionally includes an access opening 112, which provides access to the disposable inflatable devices located in housing 110 and allows the dispensing of an inflatable device from housing 110. In this manner, when a caregiver wishes to utilize a disposable inflatable device, the device may be retrieved from housing 110 and then optionally coupled to the energy supply system 12 of patient support 10 to inflate the device or coupled to an external pressure supply. Further, the opening may allow the supply of inflatable devices to be replenished or recharged, or the housing itself may be removable for replacement with another stocked housing. While the housing is described and illustrated mounted to the intermediate frame, it should be understood that housing 110 may be located elsewhere on patient support, including in or on the footboard, side rail or head board.

Figure 12:
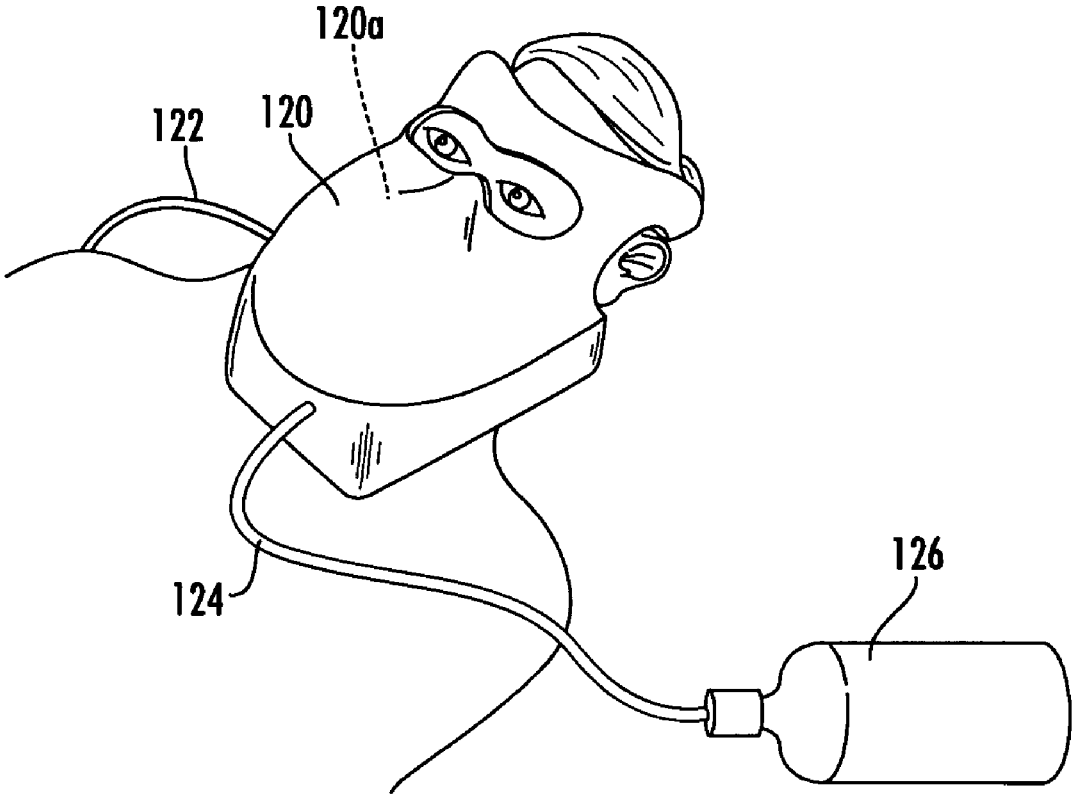
FIG. 12 is a perspective view of one embodiment of a disposable hyperbaric device.

For example, referring to FIG. 12, another suitable inflatable device may be configured as an inflatable mask 120. Mask 120 is configured to cover at least a part of a patient's face to provide treatment, such as vacuum assisted closure treatment or drug treatment or hyperbaric treatment to treat scars, for example scars from surgery. Mask 120 includes a cover, which is shaped to cover at least a portion of the patients face and further form a chamber under the cover. A conduit 122 is coupled to the cover to inflate the cover. A suitable conduit 122 includes a tube, such a flexible tube, which may be coupled to energy supply system 12 of patient support 10 to inflate mask 120. Further, inflatable device 120 may include a second conduit 124, which is in fluid communication with the chamber for delivering a vacuum pressure or pressurized fluid, such as pressurized atomized gas, including oxygen, into chamber 120*a* to form for example a hyperbaric treatment device or drug treatment device. As noted above, treatment gas, such as oxygen, may be supplied by energy supply system 12, which as noted above may be incorporated into the fluid movement system 30 described above, or by a separate treatment gas bottle 126.

Although in the illustrated embodiment inflatable device 120 is configured to form a mask for a patient's face, it should be appreciated that the inflatable device 120 may be configured to envelope or cover other areas of the patient's body.

Figure 13:
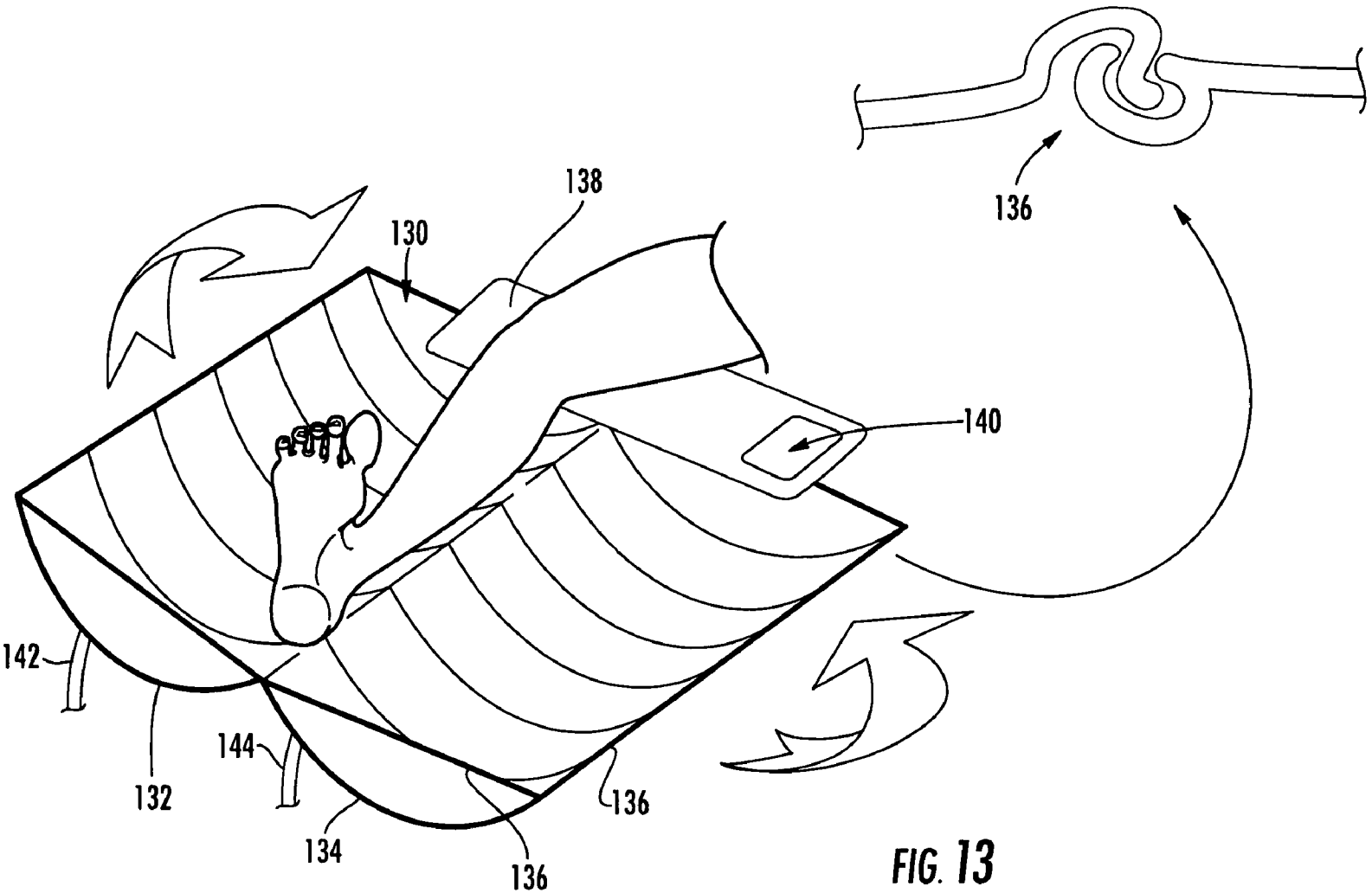
FIG. 13 is a perspective view of another embodiment of a disposable hyperbaric device.

Referring to FIG. 13, the numeral 130 designates another embodiment of an inflatable device. Inflatable device 130 comprises a foldable or wrap-around chamber, which may be positioned around a portion of the patient's body, such as the patient's leg, and used for hyperbaric treatment or vacuum assisted closure treatment or drug treatment, for example. In the illustrated embodiment, inflatable device 130 includes two halves 132 and 134, which fold around, for example the leg of a patient and which is then sealed, for example by a zip-lock seal 136 along the perimeter portions of the two halves of the chamber. Further, to ensure a proper seal around the appendage of the patient, inflatable device 130 includes a strap or collar 138, which fastens around the patient's appendage, for example using a connector 140, such as an adhesive or a Velcro strip or the like. Alternately, the perimeter portions of the two halves of the device 130 each may include a flange with a sealing surface, which are then clamped together to form an enclosed chamber around the patient's appendage. The folding or wrap-around chamber facilitates the placement of the chamber about the patient's appendage and reduces trauma to the patient when the chamber is deployed around the patient's appendage. Each half 132, 134 of inflatable device 130 may incorporate a conduit, such as a flexible tube for inflating each half of the chamber. Alternately, a single conduit may be used to inflate the entire inflatable device. As will be understood, respective conduits 142 and 144 may be coupled to the ports provided on patient support 10. Further, as noted above, disposable inflatable device 130 may be stored in housing 110, for example (FIG. 11).

Figure 15:
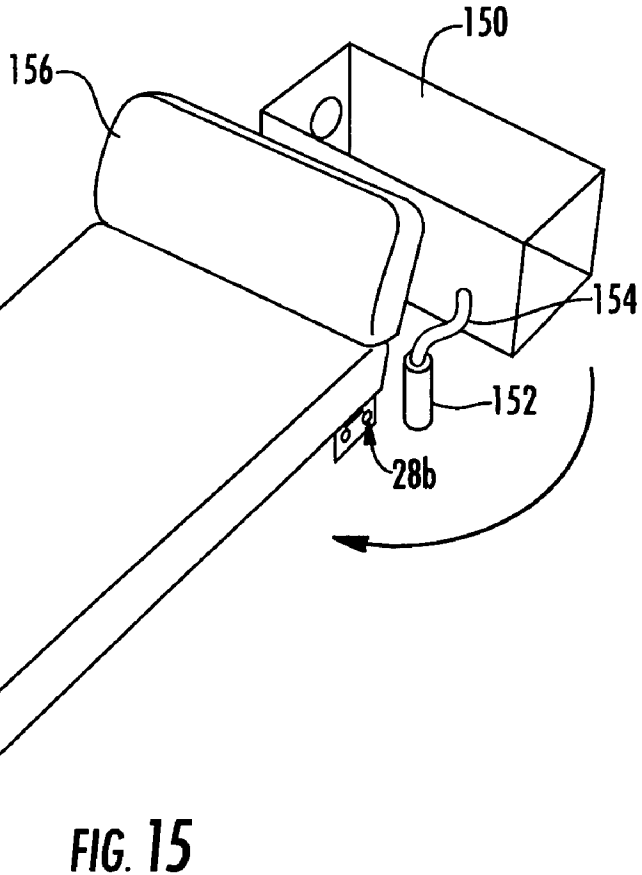
FIG. 15 is a similar view to FIG. 14 illustrating the chamber in a non-deployed position.
Figure 14:
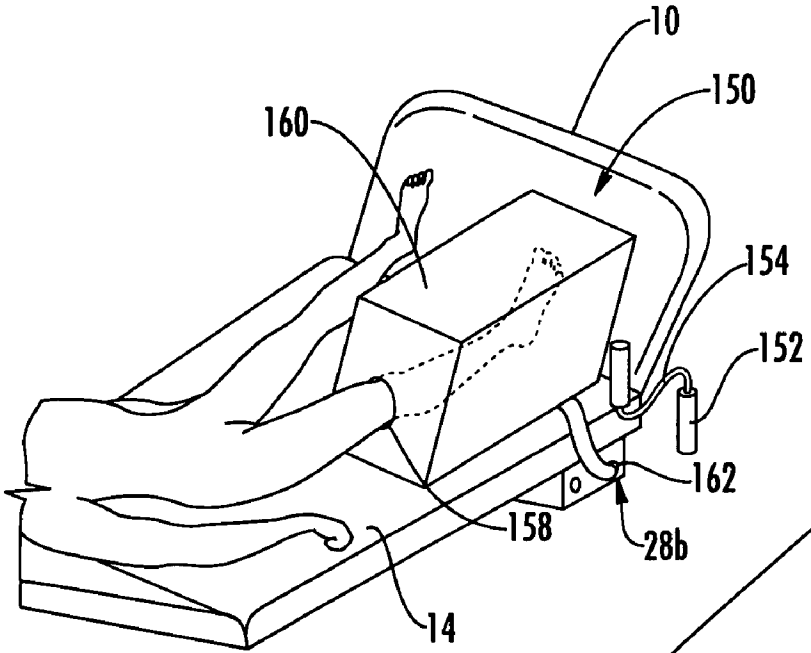
FIG. 14 is a schematic perspective view of the patient support of the present invention incorporating a chamber mounted to the patient support.

Referring to FIGS. 14 and 15, the numeral 150 designates another embodiment of a treatment device that may be incorporated into the present invention. Treatment device 150 may comprise an inflatable device or may comprise a semi-rigid or rigid device that is mounted to a patient support, including patient support 10, for example in an IV support 152 by an articulating arm 154. Arm 154 permits the device 150 to be moved from a deployed position wherein the device 150 is positioned on or at the patient support surface 14 to a stored position in which the device 150 is pivoted by arm 154 behind the footboard 156 of patient support 10. Further, arm 154 may be configured to allow easy removal of device 150 from the patient support for replacement or repair or simply for more permanent storage. In the illustrated embodiment, device 150 forms a treatment chamber, such as a hyperbaric treatment chamber, and includes an opening 158 on one end of the device that allows a portion of the patient's body to be inserted into and extend into the chamber 160 of device 150 and thereby receive treatment in the chamber for example, a treatment gas, such as oxygen, or vacuum treatment, such as vacuum assisted closure, which is commonly known in the art, or a topical drug treatment. One example of a suitable chamber is disclosed in U.S. Pat. No. 5,060,644, which is incorporated by reference herein in its entirety.

Furthermore, device 150 incorporates a conduit 162 for coupling the chamber to a supply of gas, for example a treatment gas, or to a vacuum pressure. As noted in reference to the previous embodiment, treatment gas or the vacuum pressure may be supplied by energy supply system 12 and, therefore, may similarly be coupled to one of the ports 28*a*-28*d*.

Figure 16:
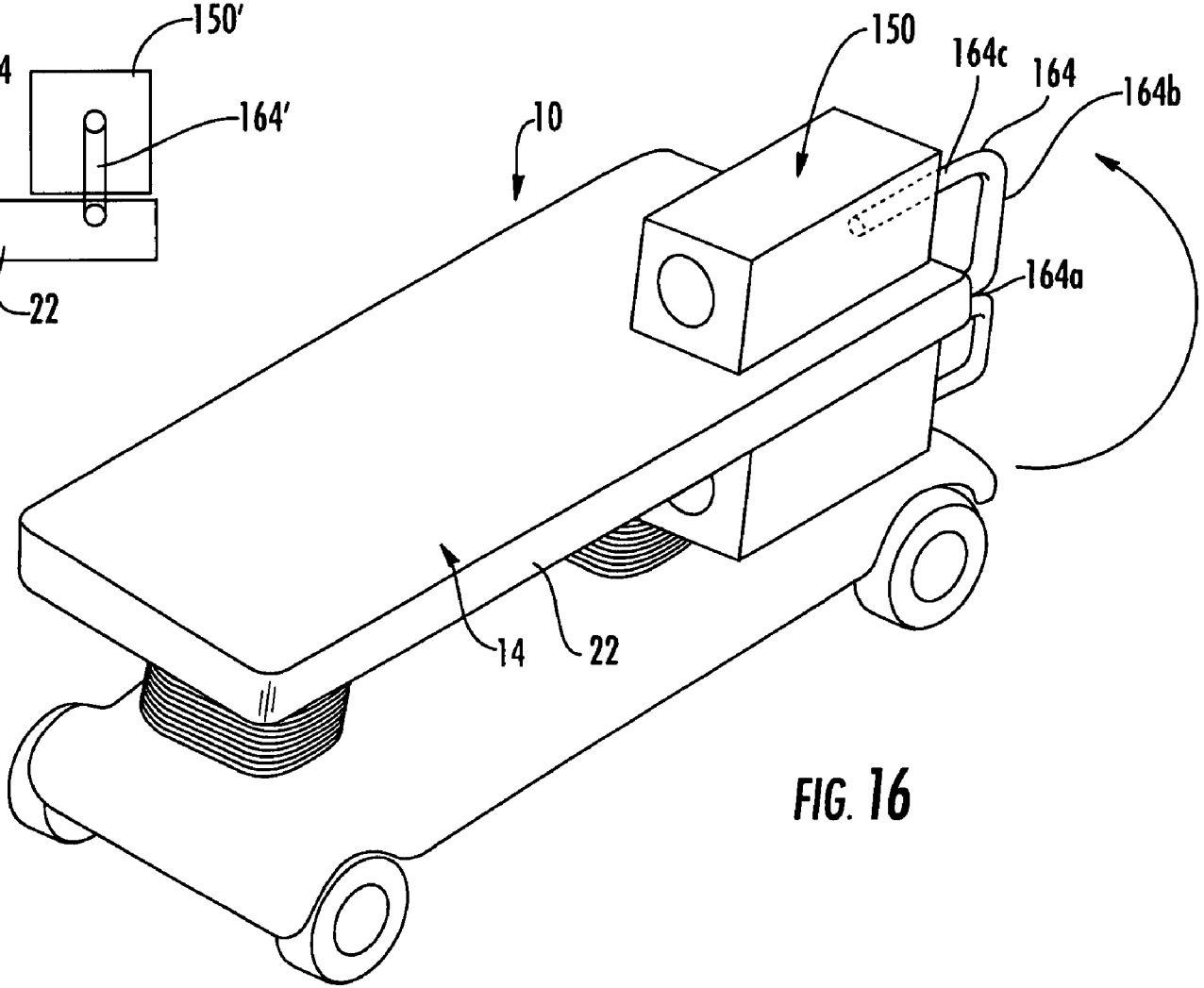
FIG. 16 is another schematic drawing of a patient support of the present invention incorporating a movable chamber that is movable between a deployed position and a stored position.
Figure 17:
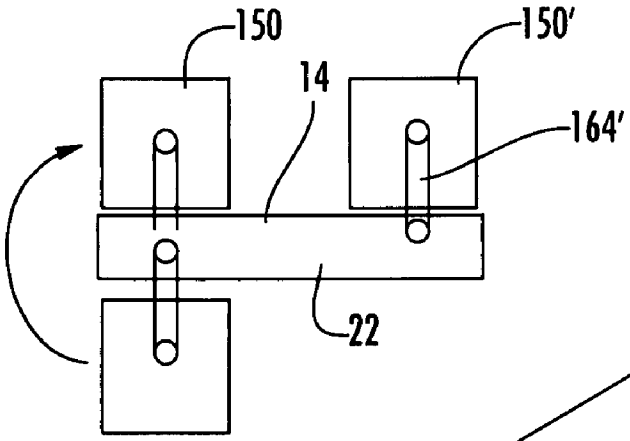
FIG. 17 is an end elevation view of the patient support of FIG. 16 illustrating a second chamber incorporated at the patient support.

Referring to FIGS. 16 and 17, device 150 may alternately be mounted by an arm 164, which permits the chamber to be pivoted between a deployed position on or just slightly above patient support surface 14 to a stored position beneath, for example intermediate frame 22. In the illustrated embodiment, arm 164 comprises generally U-shaped arm with a lower horizontal leg or arm 164*a*, which extends into a receptacle or socket provided in or below for example intermediate frame 22, and a vertical portion or arm 164*b*, which supports a second horizontal arm 164*c* vertically spaced from lower horizontal arm 164*a* and to which device 150 is mounted. In this manner, when arm 164 is pivoted about lower horizontal arm 164*a*, device 150 will pivot and move off the patient support surface in an arcuate path to beneath the intermediate frame 22. Similarly, as described in reference to the earlier embodiment, device 150 may be coupled to one of the ports provided on patient support 10 to supply treatment gas (such as oxygen), a vacuum pressure, or a treatment fluid to the chamber of the device.

Further, as best seen in FIG. 17, a second device 150' may be mounted adjacent an opposed side of support surface 14 to provide two devices for patient support 10, which is similarly mounted by an arm 164' that permits device 150' to be moved from a deployed position in which device 150' is either resting or adjacent patient support surface 14 to a stowed position beneath intermediate frame 22. In the illustrated embodiment, devices 150 are configured for providing treatment to a leg of a patient; however, it should be understood that chamber 150 may be configured for treating an arm or another portion of the patient's body.

Figure 18:
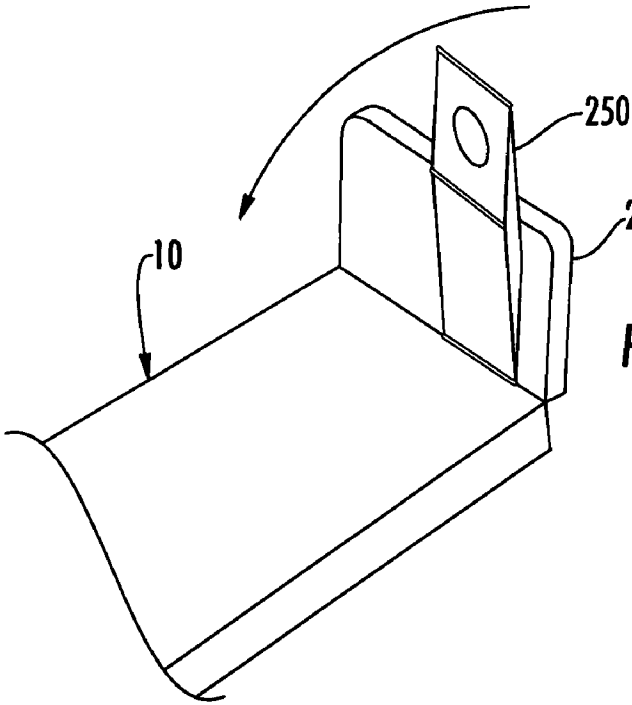
FIG. 18 is a partial perspective view of a patient support of the present invention incorporating a chamber incorporated at the foot board of the bed.
Figure 19:
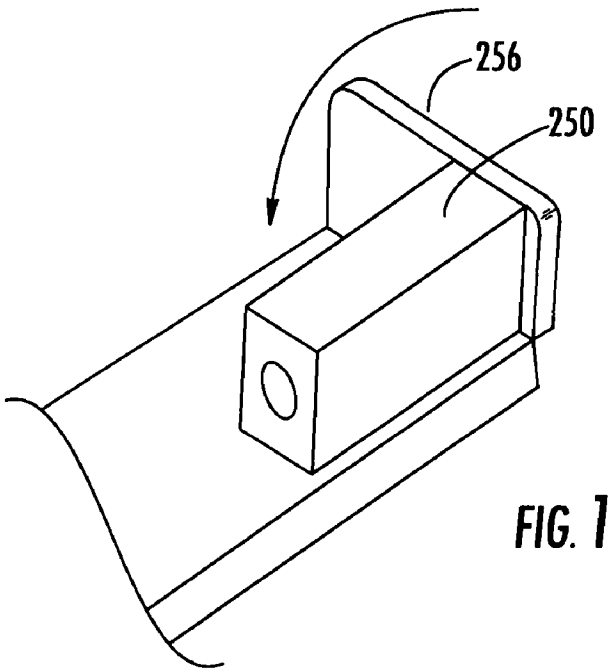
FIG. 19 illustrates the chamber in a deployed position.

Referring to FIGS. 18 and 19, another embodiment of a treatment device 250 is illustrated. In the illustrated embodiment, treatment device 250 is a foldable device that can be folded against or into footboard 256 of patient support 10 and then extended to a deployed position, such as shown in FIG. 19. Alternately, treatment device 250 may be configured with an accordion-like side so that treatment device 250 may be fully retracted into the footboard 256 and optionally may be inflated to make the sides rigid, in which case the sides of the device may be inflated by the air supply provided on bed 10.

Figure 20:
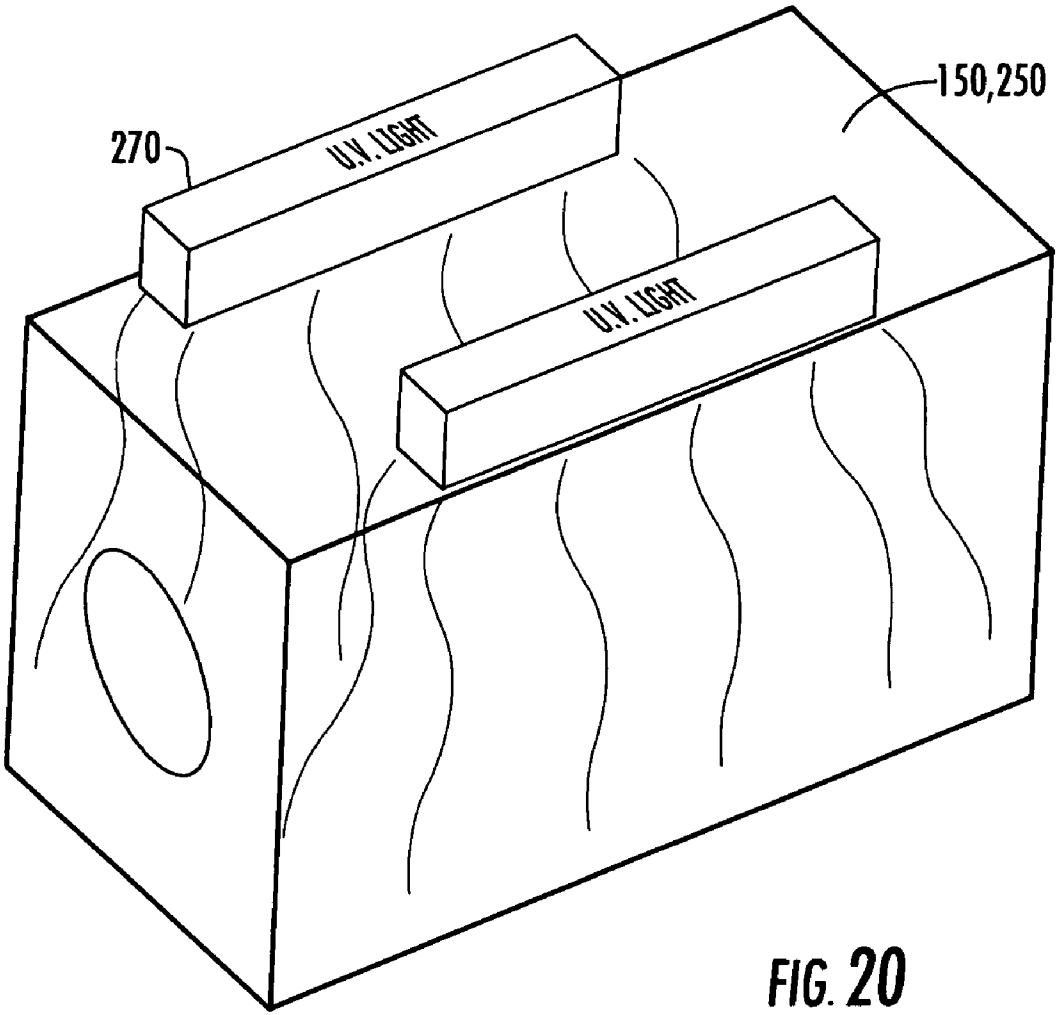
FIG. 20 illustrates a chamber of the present invention incorporating one or more devices to provide decontamination within the chamber.

Referring to FIG. 20, in each of the previous embodiments of the treatment devices, the device may be provided with an energy source 270, such as UV light that provides decontamination of the air in the chamber. In the illustrated embodiment, chamber 350 is of similar construction to chambers 150 and 250. In this manner, in addition to providing a hyperbaric or vacuum assisted closure treatment or drug treatment to a portion of a patient's body, the respective chambers may also provide decontamination and destruction of bacteria that may be located in the chamber or on the patient to facilitate healing.

Figure 22:
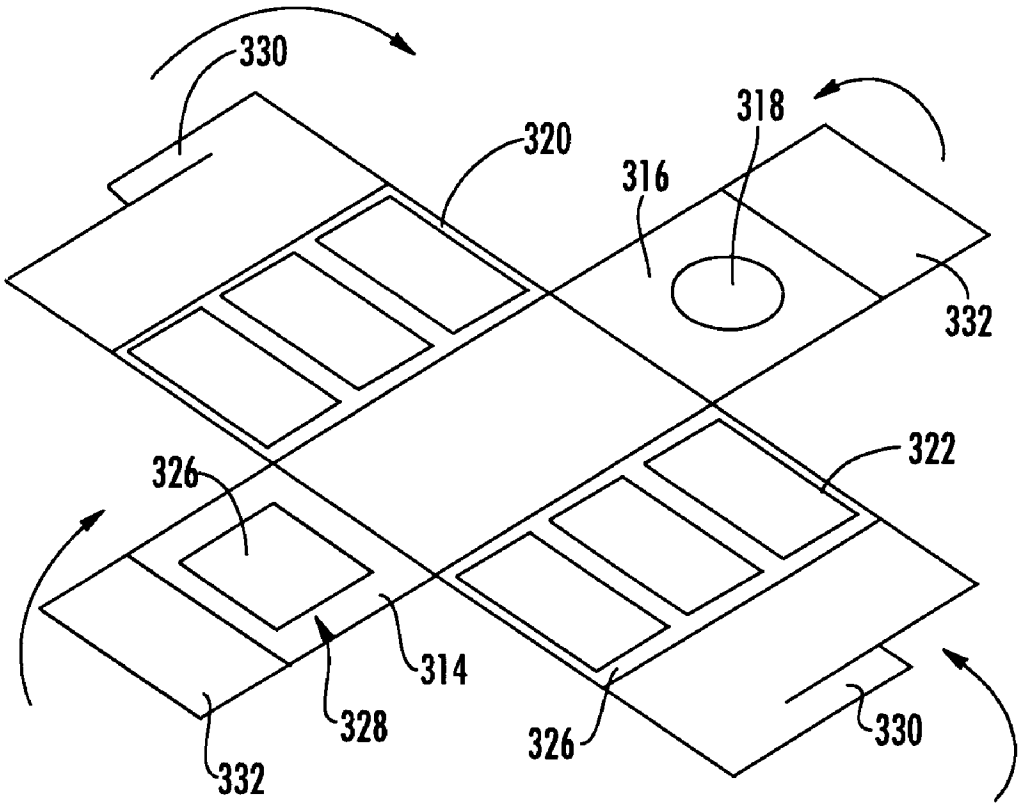
FIG. 22 is a perspective view of the blank that forms the housing.
Figure 21:
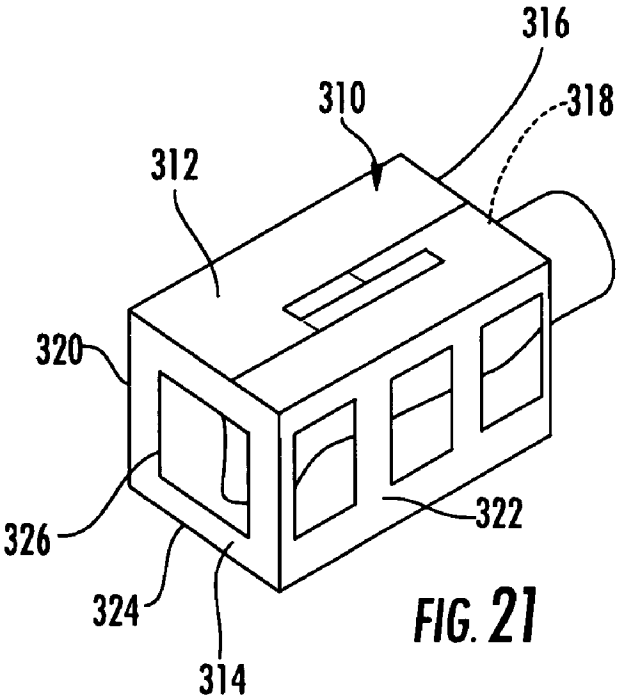
FIG. 21 is a perspective view of a housing that may be used to reinforce an inflatable chamber.

Referring to FIGS. 21 and 22, in the case of the inflatable devices, such as inflatable chambers, the inflatable devices may be optionally provided with a housing 310. Housing 310 provides reinforcement to the respective inflatable device so that when the inflatable device is inflated, the inflatable device may be reinforced and supported by housing 310, which may be particularly suitable for disposable inflatable devices that are preferably formed from plastic sheeting with fairly thin wall thickness.

In the illustrated embodiment, housing 310 includes an upper wall 312 and two opposed end walls 314 and 316, with end wall 316 including an opening 318 to receive an appendage of a patient and the inflatable device, preferable before inflation. Further, housing 310 includes opposed sidewalls 322 and a bottom wall 324. End wall 314 and sidewalls 320 and 322 may include openings 326 formed therein, which provide viewing access to the chamber and the patient's appendage that is treated therein. Referring to FIG. 22, housing 310 may be formed from a blank 328, such as a plastic blank or cardboard blank, which is folded and then secured with interlocking tabs 330 and flaps 332.

Figure 23:
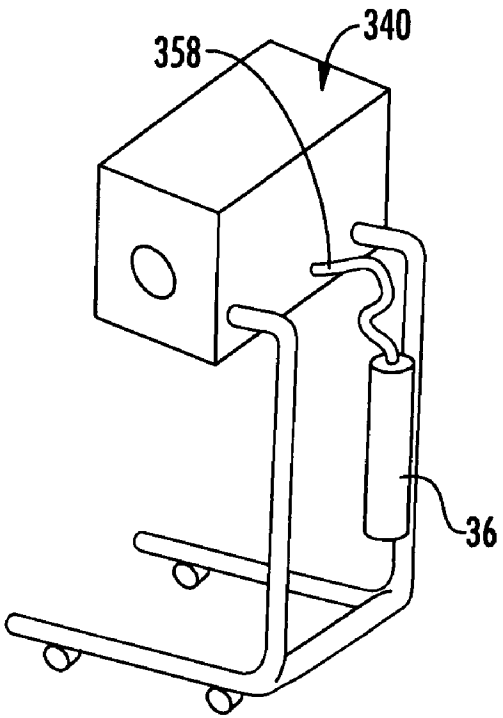
FIG. 23 is a perspective view of a portable chamber that may be used in conjunction with a patient support of the present invention.
Figure 24:
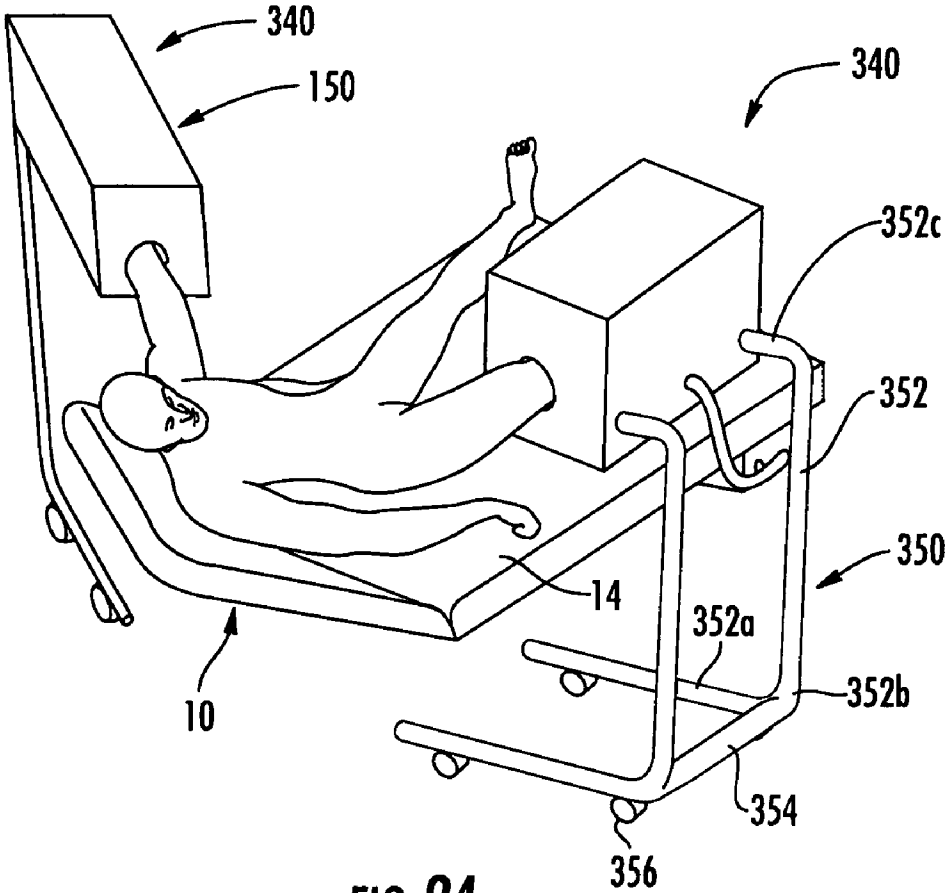
FIG. 24 is a perspective view of a patient support illustrating a patient on the patient support being treated by two of the portable chambers.

Referring to FIGS. 23 and 24, device 150 may be alternately configured as a portable device 340 and mounted to a stand 350, which permits the device to be positioned at multiple positions around the bed, and which therefore provides greater flexibility. Stand 350 is configured so that device 150 is cantilevered from the stand frame 352, which allows the device to be positioned over and optionally on patient support surface 14, similar to the previous embodiments. For example, frame 352 comprises two generally U-shaped side frame members, each with a lower horizontal leg 352*a*, a vertical leg 352*b* and a second vertically spaced horizontal leg 352*c*. The u-shaped side frame members are interconnected by brace or transverse member 354 and further are provided with wheels or rollers 356 to form a wheeled stand to further facilitate movement of the device (150). Device 150 is mounted to arms 352*c* and as noted above is cantilevered so that device can be positioned over support surface 14.

Treatment gas, such as an atomized gas or drug, or a vacuum pressure is delivered to the chamber of device 150 by a conduit 358. Conduit 358 may be coupled to an external supply, such as an external treatment gas container 360, such as a bottle or an external vacuum source, or may be coupled to the energy supply system through one of the ports 28*a*-28*d*, which may act as a conduit to an external fluid or vacuum supply, or an onboard fluid supply or vacuum source.

Figure 27:
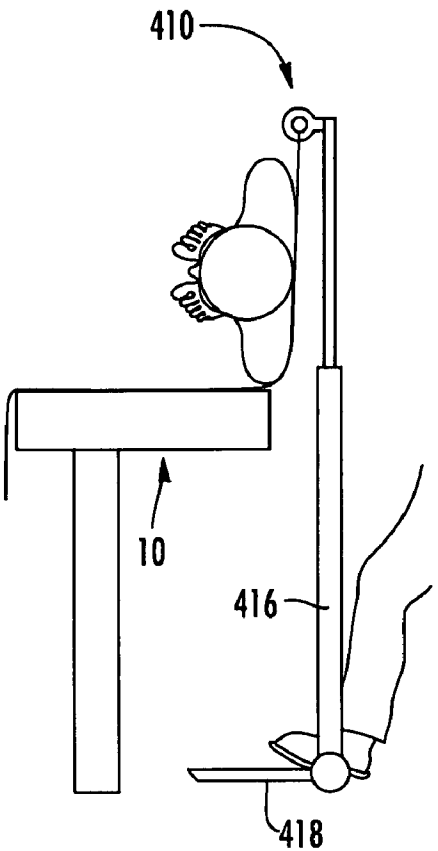
FIG. 27 is a similar view to FIGS. 25 and 26 illustrating the lifting device in the fully extended position.
Figure 26:
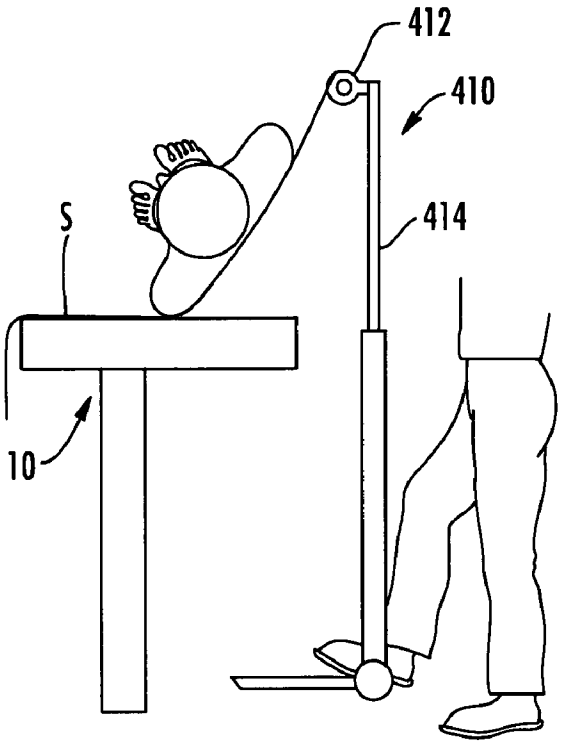
FIG. 26 is a similar view to FIG. 25 illustrating the lifting device in a partially extended position.
Figure 25:
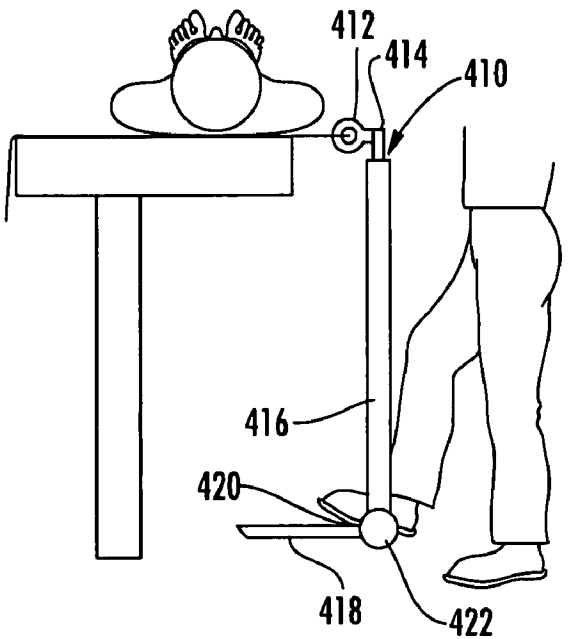
FIG. 25 is a schematic drawing of a lifting device that may be used to assist in turning a patient.

Referring to FIGS. 25-27, the numeral 410 generally designates a lifting device that may be powered by the energy supply system of the present invention. Lift device 410 includes a clamp or retainer 412 for gripping the edge of a sheet S on which a patient is laying. Clamp 412 is mounted at the distal end of an extendible member 414, which is supported for vertical movement relative to a base 418 by member 416. For example, extendible member 414 may be raised relative to base 418 and member 416 by a pneumatic cylinder, which may be powered by energy supply system 12 and housed in member 416. Actuation of the cylinder may be provided by depression of a pedal 420, such as foot pedal, or by a button or switch. Further, lift mechanism 410 may incorporate a wheel or roller 422 to facilitate movement of the lift mechanism.

As best seen in FIGS. 26 and 27, when extendible member 414 extended from member 415, clamp 412 will lift the edge of the sheet, which rolls the patient in a direction away from the lift mechanism.

Figure 28:
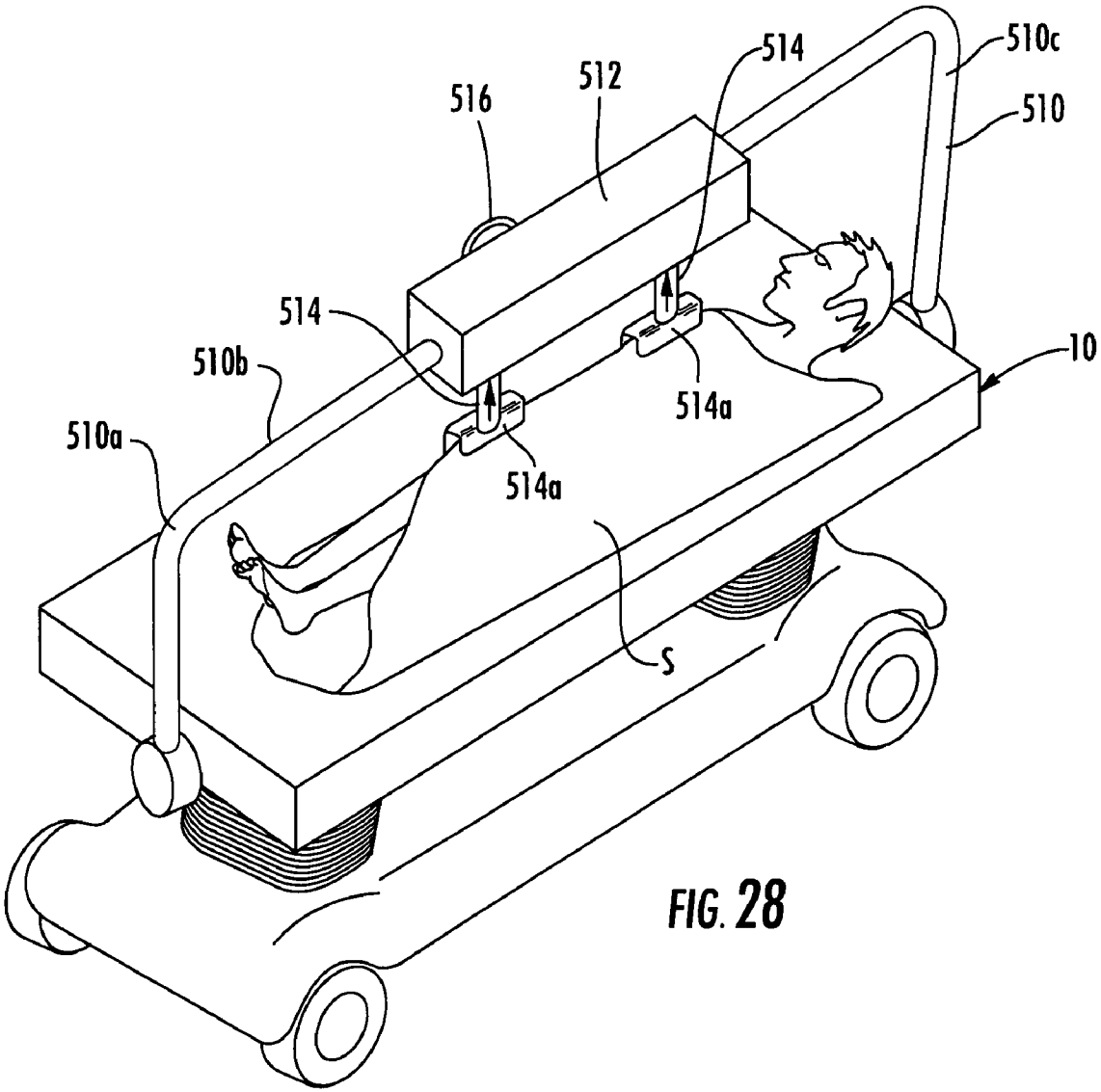
FIG. 28 is a perspective view of a patient support of the present invention incorporating a frame with lifting devices that may be used to turn a patient.

Referring to FIG. 28, another embodiment of a lifting device 510 that may be powered by the energy supply system of the patient support 10 of the present invention is illustrated. Lifting device 510 includes a housing 512 and a pair of retractable lifting straps or tethers 514 or the like which are raised or lowered by a mechanism contained in housing 512, which may be powered through conduit 516 by energy supply system 12 of patient support 10. Alternately, the lifting mechanism by be powered by electricity, which may be provide also by an onboard bed power supply or by an external power supply.

Each strap or tether includes a clamp 514*a* for gripping the edge of a sheet S on which a patient is laying. Clamps 512 are mounted at the respective distal ends of straps 514, which as noted above are supported for vertical movement relative to support surface 14. For example, straps 514 be wound around a drum and raised relative to surface 14 when the drum is rotated and the straps are coiled around the drum.

Housing 512 is mounted to support 10 by a frame with two vertical arms 510*a*, 510*c* and a horizontal arm 510*b*, which spans between arms 510*a* and 510*c* and over the length of the support surface 14. Optionally, housing 512 may be movably mounted to the frame to allow adjustment to the position of housing 512 along the longitudinal axis of support 10, which may be needed when the weight of the patient is concentrated more to one end of the support than the other end.

As would be understood, when straps 514 are retracted into housing 512, the edge of the sheet will be raised causing the patient to roll to one side of the patient support.

Further, the frame may be independently supported from the patient support, for example, on wheels or rollers to facilitate movement of the lift mechanism about support 10 or for transport to another support.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

For example, while the energy supply system has been described as providing a vacuum pressure at the ports, it is also contemplated that a separate vacuum system may be coupled to one of the ports via a vacuum generator to reduce contamination of the onboard system. In this manner, the high pressure flow of the fluid from one of the ports may be used generate a vacuum using a venturi effect in the vacuum generator, which is then coupled to a conduit which can then deliver the vacuum pressure where it is desired. These and other modifications may be made, for example, without departing from the scope of the invention as defined by the claims.

We claim:

1. A patient support comprising:

a patient support surface;

a fluid movement system provided at said patient support;

a plurality of ports mounted at said patient support in selective fluid communication with said fluid movement system, said ports being supported at different locations around said patient support surface wherein a user can use the fluid movement system from several locations around the patient without moving the fluid movement system;

at least one port of said ports being adapted for coupling to a device for delivering fluid to the device from the fluid movement system or delivering a vacuum pressure to the device from the fluid movement system for suctioning fluid through the device when the device is coupled to said at least one port; and a heating or cooling device for heating or cooling the fluid in said fluid movement system.

2. The patient support according to claim 1, further comprising a control system, said control system including a sensor for detecting the device when the device is coupled or in close proximity to a respective port of said ports, said control system controlling the flow of fluid at said respective port in response to detecting the device.

3. The patient support according to claim 2, wherein the device has a type, said sensor configured to detect the type of the device, and said control system controlling the flow of fluid at said respective port based on said sensor detecting the type of the device.

4. The patient support according to claim 1, wherein said at least one port is coupled to a device selected from the group consisting of an inflatable device, a conduit, an air operated device, an actuator, a ventilator, and a chamber.

5. The patient support according to claim 2, wherein said at least one port is coupled to a device selected from the group consisting of an inflatable device, a conduit, an air operated device, an actuator, a ventilator, and a chamber.

6. The patient support according to claim 1, wherein said patient support surface comprises a frame and a mattress, said ports being provided at said frame.

7. The patient support according to claim 1, further comprising a compressor for pressurizing the fluid in fluid movement system.

8. The patient support according to claim 1, wherein said fluid movement system includes a vacuum line in selective fluid communication with said ports wherein said vacuum line provides suction at a respective port when said vacuum line is in fluid communication with said respective port.

9. A patient support comprising:

a patient support surface;

a fluid movement system provided at said patient support;

a plurality of ports mounted at said patient support in selective fluid communication with said fluid movement system, said ports being supported at different locations around said patient support surface wherein a user can use the fluid movement system from several locations around the patient without moving the fluid movement system; and at least one port of said ports being adapted for coupling to a device for delivering fluid to the device from the fluid movement system or delivering a vacuum pressure to the device from the fluid movement system for suctioning fluid through the device when the device is coupled to said at least one port, wherein said fluid movement system is configured to provide high pressure fluid at one of said ports and low pressure at another of said ports.

10. The patient support according to claim 9, further comprising a heating or cooling device for heating or cooling the fluid in said fluid movement system.

11. The patient support according to claim 9, wherein said fluid movement system provides high volume at said low pressure port to form a high volume/low pressure port.

12. The patient support according to claim 11, wherein said fluid movement system provides low volume at said high pressure port to form a low volume/high pressure port.

13. The patient support according to claim 9, wherein control system includes a sensor for detecting the device when the device is coupled to or in close proximity to said respective port.

14. The patient support according to claim 13, wherein the device has a type, said sensor configured to detect the type of the device, and said control system controlling the flow of fluid at said respective port based on said sensor detecting the type of the device.

15. A patient support comprising:

a patient support surface;

a fluid movement system mounted at said support, said fluid movement system including a fluid delivery system, a vacuum system, and a plurality of ports in selective fluid communication with the said fluid delivery system and said vacuum system, said ports being supported at different locations around said patient support surface wherein a user may use the fluid movement system at different locations around the patient support;

a control system, said control system controlling the selective communication between said ports and said fluid delivery system and said vacuum system; and said ports being adapted for coupling to a device for delivering fluid or a vacuum pressure to the device when the device is coupled to a respective port of said ports, and said control system being configured to detect a device when the device is coupled to or in close proximity to said respective port.

16. The patient support according to claim 15, wherein said fluid movement system is configured to couple to an external fluid supply system.

17. The patient support according to claim 16, wherein said fluid movement system is configured to couple to an external vacuum system.

18. The patient support according to claim 17, said control system selectively adjusting the pressure of the fluid at said respective port based on detecting said device.

19. The patient support according to claim 15, wherein at least one of said ports is adapted to couple to a device selected from the group consisting of an inflatable device, a conduit, an air operated device, an actuator, a ventilator, and a chamber.

20. The patient support according to claim 15, wherein said fluid delivery system comprises a treatment fluid supply.

21. The patient support according to claim 20, further comprising an atomizer for atomizing the treatment fluid from the treatment fluid supply.

22. The patient support according to claim 15, wherein said patient support surface includes an inflatable bladder, a selected port of said ports being in selective fluid communication with said bladder, and said control system selectively coupling said fluid movement system with said inflatable bladder through said selected port.

23. A method of operating a device at a patient support having a frame and a patient support surface, said method comprising the steps of:

providing a fluid movement system with a fluid conduit at the patient support;

providing a plurality of ports at the patient support;

adapting a respective port of the ports for coupling to and for fluidically communicating with a device;

controlling the flow of fluid through the fluid conduit;

selectively providing fluid communication between the fluid conduit and the respective port wherein when a device is coupled to the respective port the device will have fluid communication with the fluid movement system; and adjusting a parameter of the fluid in the fluid movement system based on the device coupled to the respective port.

24. A method of operating a device at a patient support having a frame and a patient support surface, said method comprising the steps of:

providing a fluid movement system with a fluid conduit at the patient support;

providing a plurality of ports at the patient support;

adapting a respective port of the ports for coupling to and for fluidically communicating with a device;

controlling the flow of fluid through the fluid conduit;

selectively providing fluid communication between the fluid conduit and the respective port wherein when a device is coupled to the respective port the device will have fluid communication with the fluid movement system;

detecting the presence of a device when the device is coupled or in proximity to a respective port of the ports; and opening the port in response to detecting the presence of the device to allow fluid communication between the device and the fluid movement system.

25. The method according to claim 24, further comprising adjusting the pressure at the respective port based on the type of the device.

26. A patient support comprising:

a patient support surface;

a fluid movement system provided at said patient support;

a plurality of ports mounted at said patient support in selective fluid communication with said fluid movement system, said ports being supported at different locations around said patient support surface wherein a user can use the fluid movement system from several locations around the patient support without moving the fluid movement system; and at least one port of said ports being adapted for coupling to a device for delivering fluid to the device from the fluid movement system or delivering a vacuum pressure to the device from the fluid movement system when the device is coupled to said at least one port, wherein said fluid movement system is configured to provide the fluid with a first parameter at one of said ports and the fluid with a second parameter different than the first parameter at another of said ports.

27. The patient support according to claim 26, wherein said parameter comprises a volume.

28. The patient support according to claim 26, further comprising a heating or cooling device for heating or cooling the fluid in said fluid movement system.

29. The patient support according to claim 26, wherein said control system is configured to detect a device and when the device is coupled to said respective port and to control the flow of fluid at said respective port based on the device.

30. The patient support according to claim 29, wherein said control system is configured to detect the type of device.

31. The patient support according to claim 30, wherein said control system is configured to control the flow of the fluid at said respective port based on the type of the device.

32. The patient support according to claim 26, wherein said fluid movement is adapted to couple to a fluid supply or a vacuum source external to said patient support.

33. The patient support according to claim 26, wherein said fluid movement system includes a fluid supply or a vacuum source.

* * * * *